US005913623A

United States Patent [19]

Yamaguchi et al.

[11] Patent Number: 5,913,623

[45] Date of Patent: Jun. 22, 1999

[54] RECORDING APPARATUS

[75] Inventors: Koshiro Yamaguchi, Kasugai; Takashi Higashi, Nagoya; Yasuhiro Shibata, Okazaki; Kiyoshi Sugimoto, Kuwana, all of Japan

[73] Assignee: Brother Kogyo Kabushiki Kaisha, Nagoya, Japan

[21] Appl. No.: 08/962,837

[22] Filed: Nov. 3, 1997

[30] Foreign Application Priority Data

| | | | |
|---|---|---|---|
| Nov. 7, 1996 | [JP] | Japan | 8-294708 |
| Nov. 7, 1996 | [JP] | Japan | 8-294752 |
| Nov. 7, 1996 | [JP] | Japan | 8-294802 |

[51] Int. Cl.[6] ..... B41J 11/52

[52] U.S. Cl. ..... 400/605; 400/607.1; 400/323

[58] Field of Search ..... 400/605, 607, 400/607.1, 613, 613.1, 208, 240.3, 240.4, 708, 320, 322, 323

[56] References Cited

U.S. PATENT DOCUMENTS

| | | | |
|---|---|---|---|
| 4,573,814 | 3/1986 | Berruti et al. . | |
| 4,930,911 | 6/1990 | Sampson et al. . | |
| 5,080,513 | 1/1992 | Clary . | |
| 5,144,331 | 9/1992 | Amano | 400/240.4 |
| 5,183,333 | 2/1993 | Minowa | 400/605 |
| 5,232,297 | 8/1993 | Kitazawa . | |
| 5,358,351 | 10/1994 | Murata et al. . | |

FOREIGN PATENT DOCUMENTS

| | | |
|---|---|---|
| 0 451 830 A2 | 10/1991 | European Pat. Off. . |
| 3241623 A1 | 5/1984 | Germany . |
| 5-84994 | 4/1993 | Japan . |
| 7-117297 | 5/1995 | Japan . |

*Primary Examiner*—Ren Yan
*Attorney, Agent, or Firm*—Oliff & Berridge, PLC

[57] ABSTRACT

In a serial recording mode where a carriage CA mounting a recording head HD is moved reciprocatingly in a main scanning direction of a second recording medium D2, the control apparatus drives the carriage CA to move while the recording head HD is separated from a platen P2 and the sensor SY to detect the carriage CA in order to initialize the recording apparatus. In a line recording mode where recording is performed with the recording head being in contact under pressure against a first recording medium D1, the control apparatus drives the carriage CA to move while the recording head HD is separated from a platen P1 and the sensor SY to detect the carriage CA in order to initialize the recording apparatus.

29 Claims, 28 Drawing Sheets

FIG.25(B)

| | |
|---|---|
| S1 | TAPE CASSETTE TC IS SET ? |
| S2 | SENSOR SY IS ON ? |
| S3 | CONTROL FOR DETECTING HEAD STARTING POINT FOR PRESSING/RELEASING OPERATIONS |
| S4 | CONTROL FOR DETECTING HOME POSITION OF CARRIAGE IN TAPE STATION |
| S5 | CONTROL FOR DETECTING HOME POSITION OF ROLLER HOLDER |
| S6 | CONTROL FOR DETECTING HOME POSITION OF ROLLER HOLDER |
| S7 | MOVE CARRIAGE TO HEAD RELEASE AREA |
| S8 | CONTROL FOR DETECTING HEAD STARTING POINT FOR PRESSING/RELEASING OPERATIONS |
| S9 | CONTROL FOR DETECTING HOME POSITION OF CARRIAGE IN TAPE STATION |

FIG.27(B)

| | |
|---|---|
| S11 | TAPE STATION RECORDING COMMAND ? |
| S12 | DISCRIMINATE BETWEEN CASSETTES RC AND TC |
| S13 | IT IS IN AGREEMENT WITH RECORDING START KEY ? |
| S14 | RECORDING IN TAPE STATION |
| S15 | ERROR DISPLAY |
| S16 | WIDE STATION RECORDING COMMAND ? |
| S17 | DISCRIMINATE BETWEEN CASSETTES RC AND TC |
| S18 | IT IS IN AGREEMENT WITH RECORDING KEY ? |
| S19 | WIDE STATION RECORDING COMMAND ? |

RECORDING APPARATUS

BACKGROUND OF THE INVENTION

1. Field of the Invention

The present invention relates to a recording apparatus for printing images such as characters, marks, and the like on a first or a second recording medium, and more particularly to a recording apparatus capable of being selectively operated in a line recording mode for performing recording on the first recording medium by using a recording head fixed while feeding the first recording medium and in a serial recording mode for performing recording on the second recording medium by making the recording head scan the second recording medium.

2. Description of Related Art

The applicant has proposed a recording device for producing label tape disclosed in U.S. Pat. No. 5,232,297. The device is provided with a keyboard, a display, and a recording mechanism of a thermal recording type. In such a device, the thermal head prints characters and marks of an input text on a recording tape through an ink ribbon to make a label affixable to a spine of a file and the like.

The label made of the recording tape has a width, for example, 6 mm, 9 mm, 12 mm, 18 mm, and 24 mm, and can be printed thereon images such as characters and marks with various sizes and fonts in correspondence with the width of the label tape. The above label tape has been recently used not only for the spine of a file but also information boards, price cards and others. The label tape is accordingly desired to have a wider width than the above widths and to be usable for a color printing.

The above device is operated in a line recording mode for performing recording by fixing a recording head while feeding a recording tape. This device thus needs recording heads having larger widths corresponding to the width of a label tape to be printed, resulting in high cost.

Another recording device has conventionally been proposed as disclosed in Japanese Patent Application Laid-open No. 7-117297, which can be operated in a line recording mode for performing recording on a recording sheet by using a fixedly supported recording head and in a serial recording mode for performing recording by making the recording head scan the recording sheet. In this recording device, the recording head performs recording on a small-width sheet in the line recording mode and, alternatively, on a larger-width sheet in the serial recording mode by being rotated by an angle of 90° to scan the recording sheet in an orthogonal direction with respect to the feeding direction of the sheet. The rotational mechanism of the recording head may cause a large-sized device and an increased the manufacturing cost thereof.

Meanwhile, a recording apparatus is conventionally provided with a recording head, a platen for supporting recording paper which is fed with respect to the recording head, and a cutting unit disposed in a downstream side of the platen, for cutting the recording paper. In such the recording apparatus, upon completion of recording using the recording head on the recording paper, this paper is fed toward the cutting unit and is cut by the cutting unit.

When the cutting unit is driven to cut the recording paper, however, a cutter and the like of the cutting unit tends to pull the recording paper, which may generate backlash in a gear train used as a feeding mechanism for feeding the recording paper. Accordingly, when the apparatus drives the cutting unit to cut the recording paper after recording and successively drives the recording head to perform recording again on the recording paper, there may occur so-called white lines between recorded portions before and after a cutting operation and extreme overlap of the recorded portions.

SUMMARY OF THE INVENTION

The present invention has been made in view of the above circumstances and has an object to overcome the above problems and to provide a recording apparatus capable of performing recording with a recording head on a first recording medium in a line recording mode and on a second recording medium in a serial recording mode, and of being manufactured at low cost.

A second object of the present invention is to provide a recording apparatus capable of preventing the occurrence of white lines and extreme overlap between recorded portions of a recording medium before and after a cutting operation.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a recording apparatus of this invention comprises a recording head mounted on a carriage, on which a plurality of recording elements are arranged in a row, a first feeding means for feeding a first recording medium in a first direction with respect to the recording head, a line recording mode setting means for setting a line recording mode wherein the recording head in a fixed position performs recording on the first medium while the first feeding means feeds the first recording medium in the first direction, a carriage moving means for moving the carriage reciprocatingly in the first direction, a second feeding means for feeding a second recording medium in a second direction which is different from the first direction, and a serial recording mode setting means for setting a serial recording mode wherein the recording head performs recording on the second recording medium which is in a stopped state while the carriage moving means moves the carriage mounting thereon the recording head in the first direction with respect to the second recording medium.

The above apparatus can, accordingly, perform recording on the first recording medium in the line recording mode wherein the recording head is fixedly supported with respect to the first recording medium while the first feeding means feeds the first recording medium in a first direction and on the second recording medium in the serial recording mode wherein the carriage moving means is driven to move the recording head reciprocatingly in the first direction without needing rotation of the recording head.

According to another aspect of the present invention, there is provided a recording apparatus comprising a recording head having an arrangement row of recording elements, a feeding means for feeding an elongated recording medium in a direction of the arrangement row of recording elements with respect to the recording head, the feeding means feeding the recording medium by a first length approximately corresponding to a length of the arrangement row of the recording elements, a cutting unit for cutting the recording medium, disposed downstream of the recording head along a feeding direction of the recording medium, a first control means for controlling the feeding means to stop while a recording operation being performed with the recording head, and a second control means for controlling the feeding means to feed the recording medium by a second length less than the first length just before a cutting operation by the cutting unit and to feed the recording medium by a third length left by subtracting the second length from the first length after the cutting operation.

In the recording apparatus, the second control means controls to feed the recording medium by a second feeding amount less than the first length just before a cutting operation by the cutting unit and by a remaining third amount after the cutting operation, and then controls the recording head to perform recording again on the recording medium. Accordingly, even if backlash is produced in the gear train used for a feeding mechanism for feeding the recording medium, resulted from that the recording medium is pulled by the cutter and the like of the cutting unit, it is sufficient to regulate the feeding amount of the recording medium corresponding to the backlash in feeding the recording medium by the remaining amount. This can prevent white lines and extreme overlap between recorded portions on the recording medium before and after the cutting operation.

According to a third aspect of the present invention, there is provided a recording apparatus comprising, a recording head mounted on a carriage, on which a plurality of recording elements are arranged in a raw, a first feeding means for feeding a first recording medium with respect to the recording head, a line recording mode setting means for setting a line recording mode wherein the recording head in a fixed position which defines a first station performs recording on the first recording medium, while the first feeding means feeds the first recording medium, a carriage moving means for moving the carriage reciprocatingly in a second station which different from the first station, a second feeding means for feeding a second recording medium, and a serial recording mode setting means for setting a serial recording mode wherein the recording head performs recording on the second recording medium which is in a stopped state, while the carriage moving means moves the carriage mounting thereon the recording head in the second station.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 4(*b*) is a plane view showing the above relation;

FIG. 26(*b*) is a plane view showing the above relation; and

DETAILED DESCRIPTION OF THE PREFERRED EMBODIMENTS

A detailed description of a preferred embodiment of a recording apparatus embodying the present invention will now be given referring to the accompanying drawings.

Figure 1:
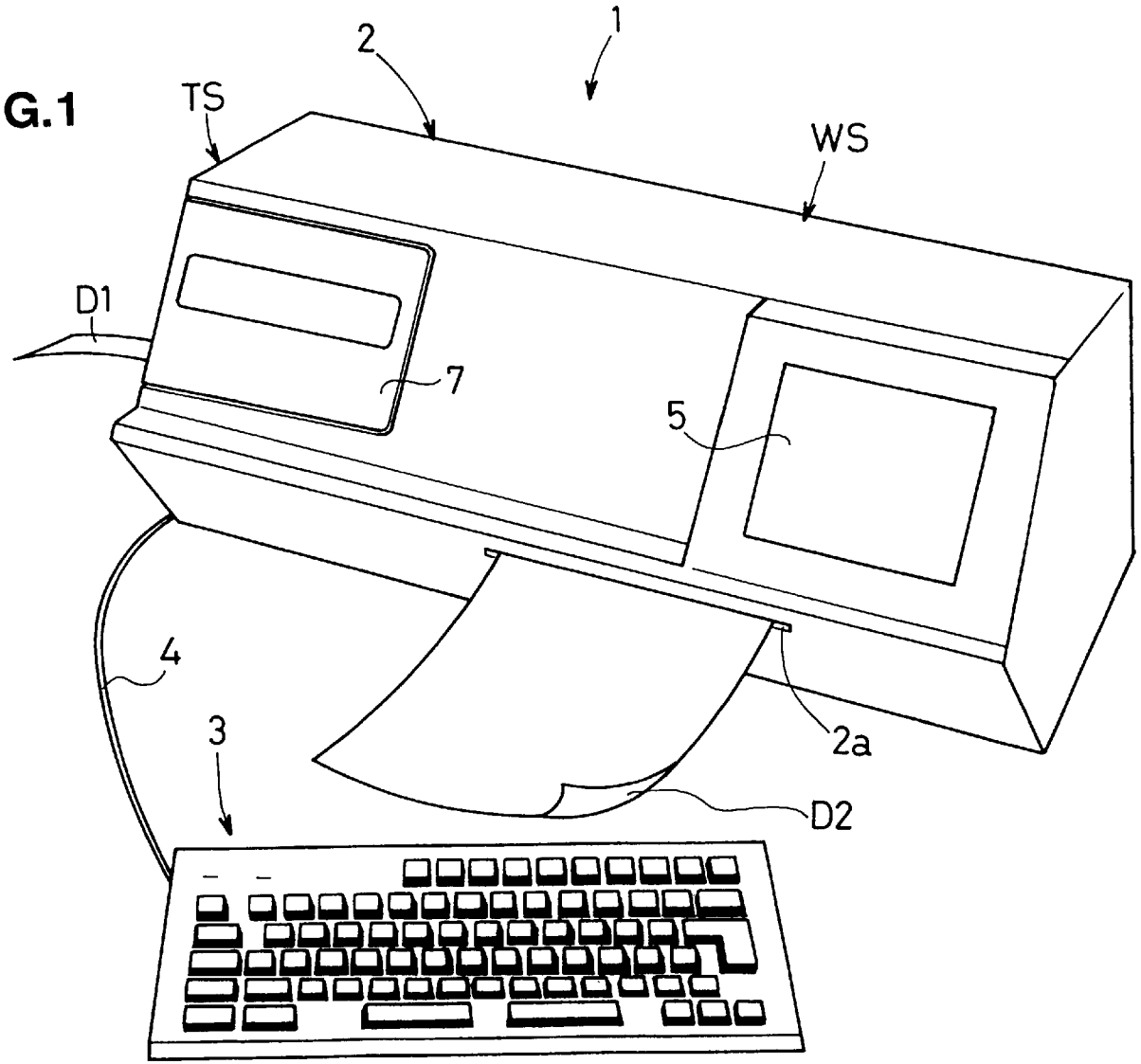
FIG. 1 is a perspective view of a tape printing apparatus in an embodiment according to the present invention.

A recording apparatus in the embodiment is a tape printing apparatus 1 for printing various images such as characters including alphabets and symbols, etc., and marks on a recording medium (tape) having a small or large width. In this tape printing apparatus 1, a tape station TS for recording the images with single color on a small-width recording medium D1 as a first recording medium and a wide station WS for recording the images with any of multiple or single color(s) on a large-width recording medium D2 as a second recording medium. The tape printing apparatus 1 discharges the first recording medium D1 printed with a single color in the tape station TS from a discharge port (not shown) formed in a side wall (in a left side in FIG. 1) of a main body frame 2, alternatively, the second recording medium D2 printed with multiple or single color(s) in the wide station WS from another discharge port 2*a* formed in the substantially center of a front face of the main body frame 2.

A keyboard 3 has a return key, a plurality of character keys for inputting alphabet and other characters, mark keys, and further various keys, for example, edition keys such as a cancel key, selection keys for selecting a vertical/lateral printing. The keyboard 3 is connected to the tape printing apparatus 1 through a cable 4, whereby signals representing data input with the various keys of the keyboard 3 can be transmitted to the tape printing apparatus 1. On the front right face of the main body frame 2 (in a right side in FIG. 1), also provided is a display 5 for displaying thereon the images such as characters and others input with the keyboard 3 in a plurality of lines.

A cover 7 is provided in another side (left side in FIG. 1) of the front face of the main body frame 2. This cover 7 can be opened forward. Accordingly, an user can open the cover 7 and insert, on a carriage CA, one of a tape cassette TC to be used for a recording operation in the tape station TS and an ribbon cassette RC of multiple or single color(s) to be used for a recording operation in the wide station WS according to which recording medium the user makes a choice, the first recording medium D1 or the second medium D2. Note that the tape printing apparatus 1 in the embodiment records images with a single color on the first recording medium D1 in the tape station TS. The invention, however, is not limited to this embodiment and may be modified to be printable with full colors.

Figure 2:
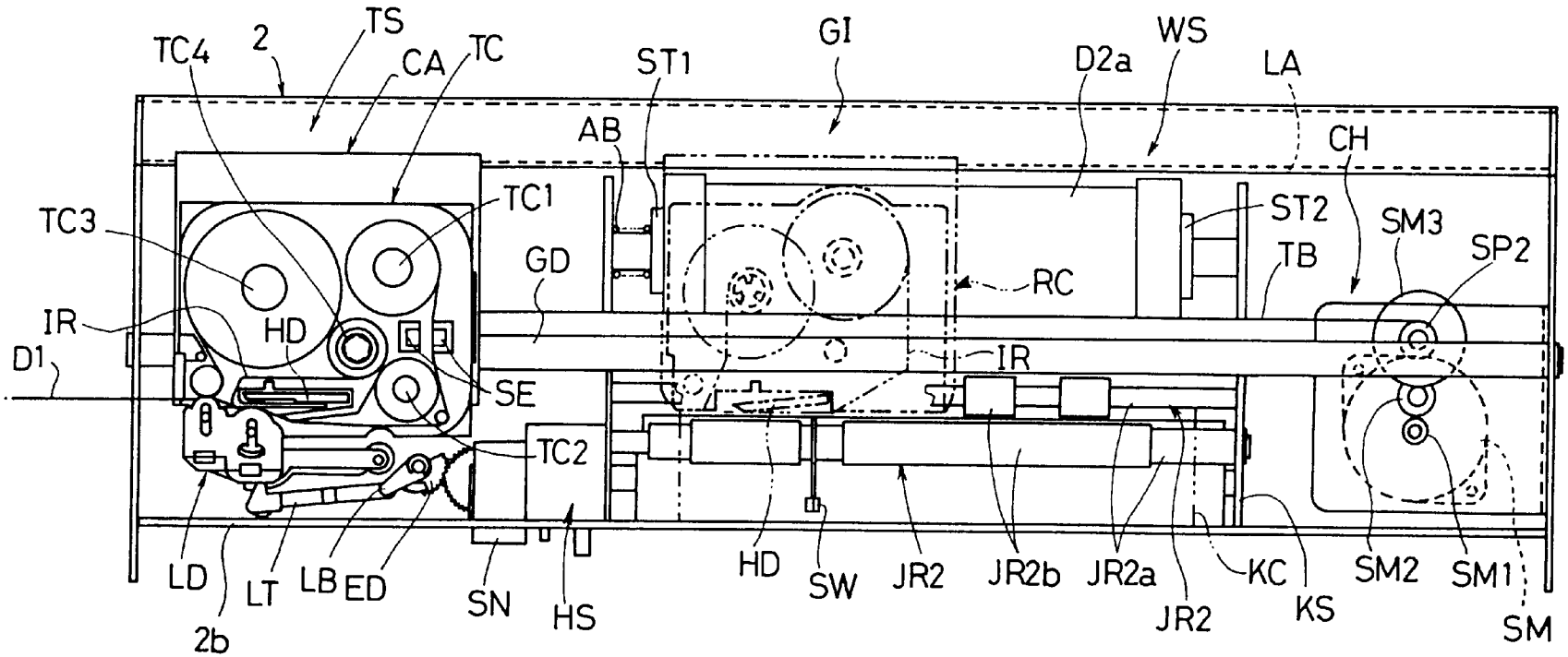
FIG. 2 is a front view of an internal structure of the tape printing apparatus of FIG. 1.
Figure 3:
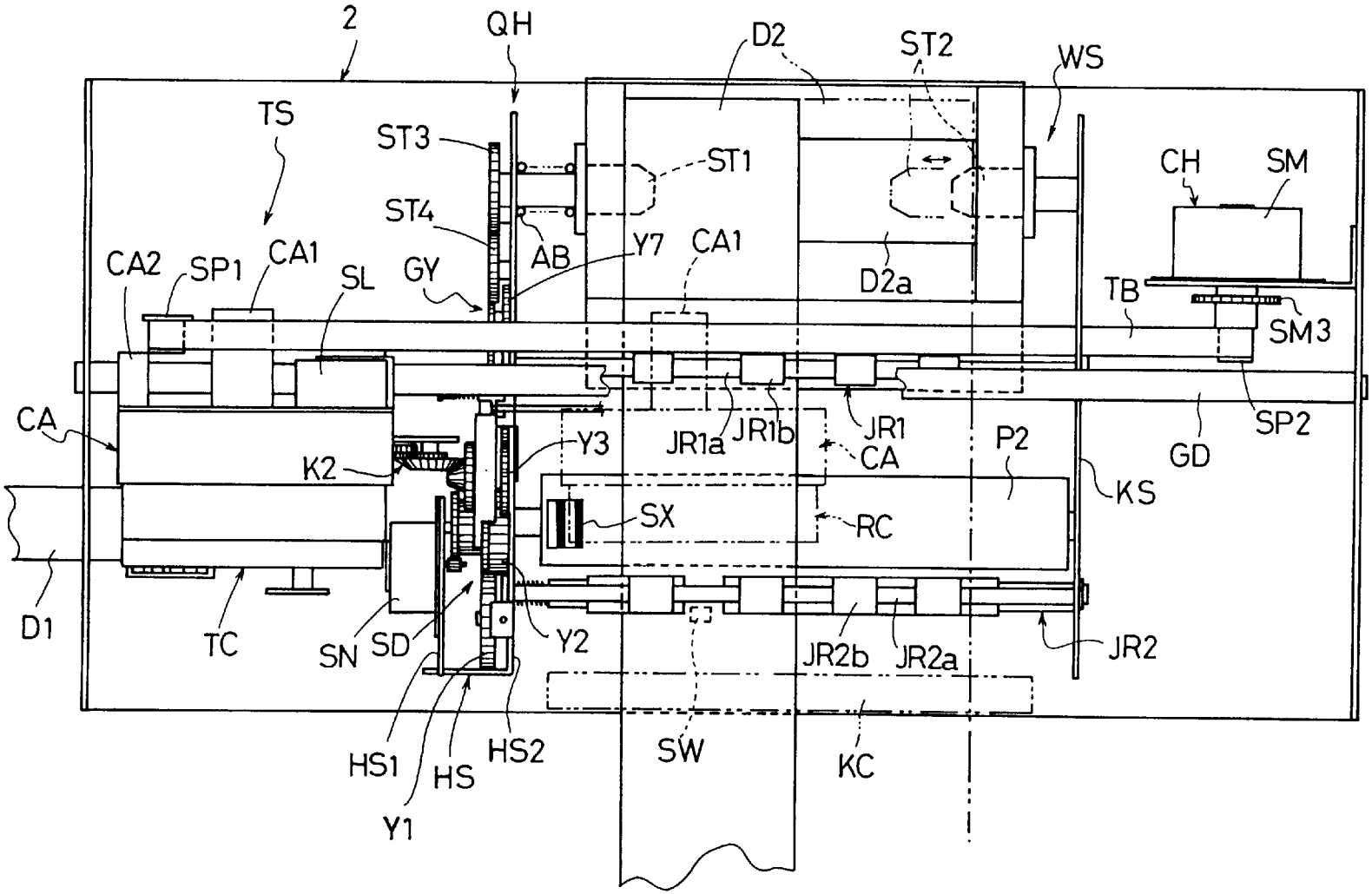
FIG. 3 is a plane view of the internal structure of the tape printing apparatus of FIG. 1.

FIG. 2 is a front view of main components of a recording mechanism of the tape printing apparatus 1 and FIG. 3 is a plane view of the same. The tape station TS is a recording area disposed at a left side in the drawings of a base chassis HS of the main frame 2, as shown in FIGS. 2 and 3. The wide station WS is another recording area disposed at a right side in the drawings of the base chassis HS. In the tape station TS, a recording operation is performed in a line recording mode wherein the first recording medium D1 drawn out of the tape cassette TC and an ink ribbon IR to be used for recording the images on the first recording medium D1 are fed in the same direction, namely, in a sideward direction toward the outside of the main frame 2, and the recording head (thermal head) HD fixedly supported on the carriage CA records images through the ink ribbon IR on the first recording medium D1. A recorded part of the first recording medium D1 is then discharged through the discharge port formed at the side of the main frame 2.

On the other hand, in the wide station WS, a recording operation is conducted on the second recording medium in a serial recording mode by moving the recording head HD in a main scanning direction (a first direction), i.e., in a lateral direction in FIGS. 2 and 3, which intersects a feeding direction of the second recording medium D2 (a second direction), i.e., in an up and down direction in FIG. 3. After recording, the second recording medium D2 is fed by a predetermined amount in the feeding direction, and the recording head HD records again while being moved in the main scanning direction.

Figure 4:
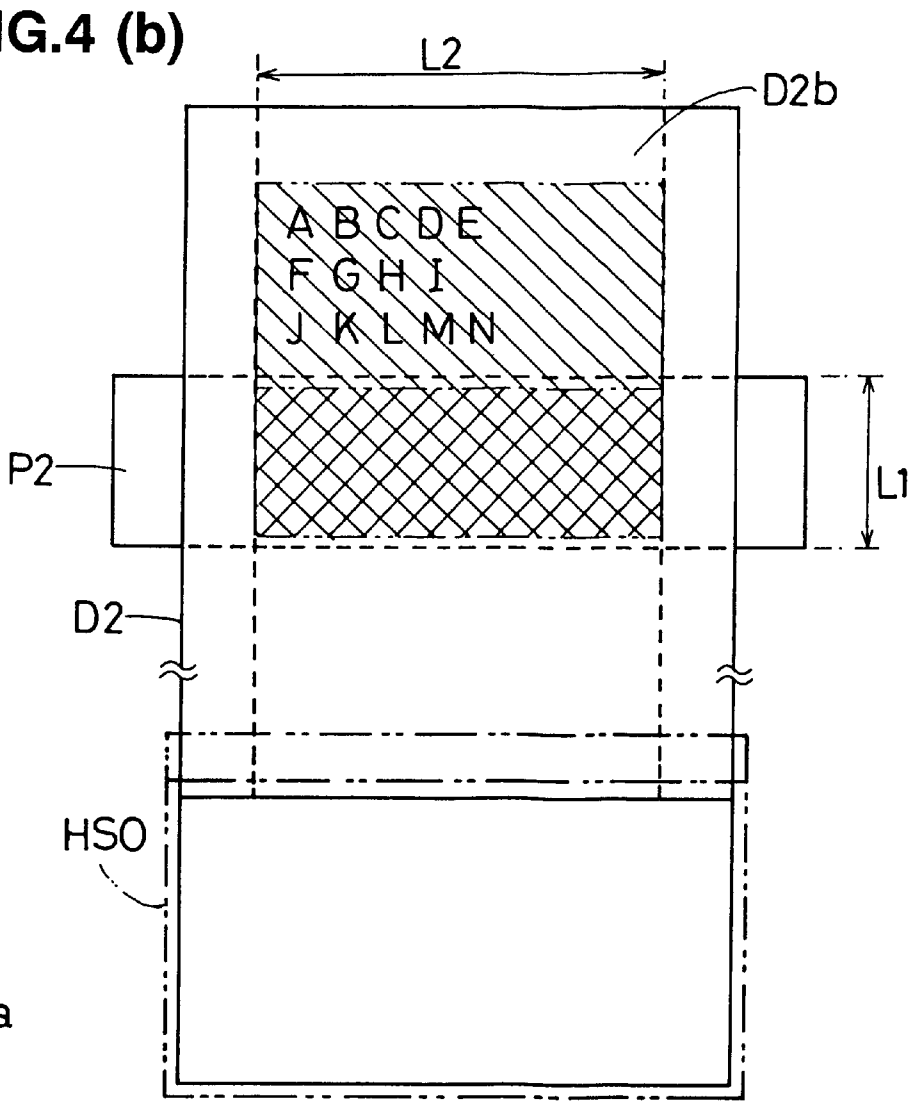
FIG. 4(*a*) is a side view showing a relation between a large-width recording medium and a recording head in the tape printing apparatus.
Figure 4:
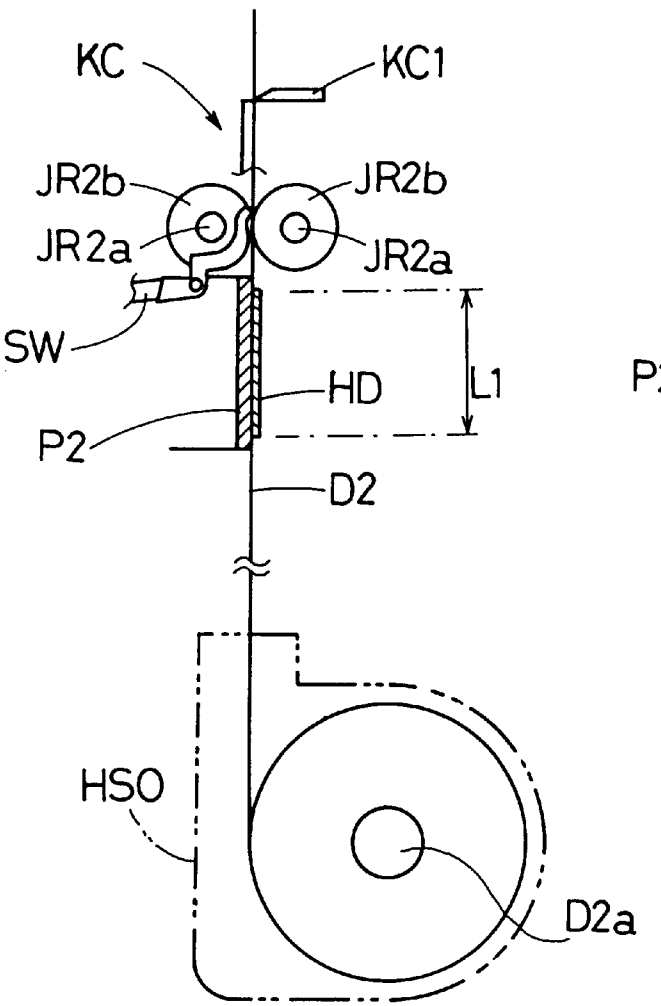

More specifically, while a carriage moving mechanism CH moves the carriage CA mounting thereon the recording head HD reciprocatingly in the main scanning direction intersecting the feeding direction of the second recording medium D2, the recording head HD records images such as the characters "ABCDE" in a line in the main scanning direction and "FGHI" in another line at the same time, as shown in FIG. 4(*b*), on the second recording medium D2. Upon completion of the recording processing, a feeding mechanism QH feeds the second recording medium D2 by a predetermined amount in correspondence with an arrangement length L1 of a plurality of heating elements serving as recording elements (see FIG. 4(*a*)) in the feeding direction, i.e., in an up and down direction in FIG. 3. The carriage moving mechanism CH moves again the carriage CA in the main scanning direction with respect to the second recording medium D2, and the recording head records the characters "JKLMN" in a third line on the second recording medium D2, then repeating the same processing as above.

As shown in FIGS. 2 and 3, this carriage moving mechanism CH is provided with a step motor SM disposed at a right side in the main frame 2, a small diameter gear SM2 attached so as to mesh with a driving shaft SM1 of the motor SM, a large diameter gear SM3 meshing with the gear SM2, a driving pulley SP2 which rotates integrally with the gear SM3 for rotating a timing belt, a follower pulley SP1 disposed in a left side in the main frame 2, which feeds the timing belt in cooperation with the driving pulley SP2, the timing belt TB laid over the pulleys SP1 and SP2 and secured to a rear end portion CA1 of the carriage CA, and a guide rod GD extending between both side walls of the main frame 2, penetrating a rear end portion CA2 of the carriage CA for supporting the carriage CA.

When the step motor SM is driven to rotate regularly or reversely, the driving pulley SP2 is rotated in a direction or reverse through the driving shaft SM1 and the driving gears SM2 and SM3, moving the timing belt TB in a direction or reverse. According to the movement of the timing belt TB, the carriage CA on which the recording head HD is mounted is moved by step-feeding between the pulleys SP1 and SP2 along the guide rod GD in a lateral direction in FIGS. 2 and 3, whereby the carriage CA can be positioned at the tape station TS as shown by a solid line in FIGS. 2 and 3 or can be moved reciprocatingly within the recording area of the wide station WS as shown in a two-dot chain line in FIGS. 2 and 3. Note that a pulse number for controlling the step motor SM exactly corresponds to a feeding amount of the timing belt TB. When pulses of a predetermined number is supplied to the step motor SM, accordingly, the timing belt TB is fed by a predetermined amount, thereby precisely moving the carriage CA.

The feeding mechanism QH for the second recording medium D2 is provided with support members ST1 and ST2 for supporting the second recording medium D2 as a rolled state, disposed in the back side of the main frame 2, paper feeding roller members JR1 and JR2 disposed in that order, parallel to the main scanning direction and separately from each other by a predetermined distance in the feeding direction (sub-scanning direction) of the second recording medium D2. More specifically, the supporting members ST1 and ST2 are respectively secured between a long side chassis HS2 of the chassis HS and a chassis KS. These supporting members ST1 and ST2 are inserted from both sides of the rolled second recording medium D2 into an axial hollow portion D2*a* thereof to support the second recording medium D2 (see FIG. 4). It is noted that a cassette case HS0 shown by a two-dot chain line in FIGS. 4(*a*) and 4(*b*) is preferably used to accommodate therein the rolled second recording medium D2, but it is not limited thereto.

In the above case, a compression spring AB is attached to the supporting member STI fixed to the base chassis HS thereby to bias the supporting member ST1 toward the chassis KS. The supporting member ST2 fixed to the chassis KS is movable toward the supporting member ST1 in correspondence with a width of the second recording medium D2, as shown by a one-dot chain line in FIG. 3. Accordingly, both the supporting members ST1 and ST2 can surely support the second recording medium D2 as rolled according to different widths of the second recording medium D2, for example, shown by a solid line or a two-dot chain line in FIG. 3. The top end of the second recording medium D2 can thus be fed toward the roller members JR1 and JR2.

These roller members JR1 and JR2 are each disposed rotatably between the long side chassis HS2 of the base chassis HS and the chassis KS secured in the wide station WS side, as mentioned above. A step motor SN is mounted on a short side chassis HS1 of the base chassis HS in the tape station TS side. Driving power of the motor SN in being regularly or reversely rotated is transmitted through a gear train GY disposed parallel to the long side chassis HS2 to the roller members JR1 and JR2 and the supporting member ST1, thereby rotating them clockwise or counterclockwise. The gear train GY includes gears Y1–Y7, ST3, and ST4 and others which will be described in detail.

The roller member JR1 is constructed of a pair of roller shafts JR1*a* and a plurality of separate rollers JR1*b* mounted on each of the upper and lower roller shafts JR1*a*, the rollers JR1*b* mounted respectively on the upper and lower shafts JR1*a* being in firmly contact to each other. The roller member JR2 has the substantially same structure as the JR1*a*. With those roller members JR1 and JR2, the top end of the second recording medium D2 is caught between the rollers JR1*b* of the roller members JR1 and then between the rollers JR2*b* of the roller members JR2, so that the second recording medium D2 is fed forward in accordance with the rotation of the roller members JR1 and JR2 or backward to be rewound.

A second platen P2 is provided on the base of the main frame 2, below the carriage CA moving parallel to and between the roller members JR1 and JR2. This second platen P2 is designed to have a substantially flat surface on which the second recording medium D2 is to be supported. If the second platen P2 is a cylindrical platen, the row of the heating elements of the recording head HD is orthogonal to the axis of the second platen P2, the heating elements in both sides of the row can not be fully in contact under pressure against such the cylindrical platen, so that it will tend to result in patchy and missing recorded medium. Consequently, to prevent the above problem, a flat platen is preferably used as the second platen P2.

On an upper left surface (a left side in FIG. 3) of the platen P2, a sensor mark SX is formed to be used for detecting a home position of the recording head HD in the wide station WS in the reciprocating movement of the recording head HD along the guide rod GD. When a control unit CP of the tape printing apparatus 1 transmits a predetermined number of pulses to the step motor SM to move the recording head HD reciprocatingly in the main scanning direction during the recording operation, the home position based on the mark SX of the second platen P2 is a standard point for controlling the position of the recording head HD.

Concretely, the mark SX is formed of two patterns each having a reflection part and a non-reflection part alternately arranged, and attached on the second platen P2. A reflecting sensor (not shown) mounted on the carriage CA detects the mark SX as a target. The control unit CP determines the position where the reflecting sensor detects twice a change point from the reflection part to the non-reflection part as the home position of the carriage CA. The reason why the mark SX has two patterns is that if only one change point is used, the control unit CP should determine by mistake a border of a white recording medium D2 with respect to a black platen P2 as the change point. Accordingly, it is preferable to form the sensing mark SX having two patterns as above to prevent the error detection.

Near the roller members JR2 in a downstream thereof, provided is a detection sensor SW for detecting the top end of the second recording medium D2. The second recording medium D2 is controlled to be fed in accordance with output signals from the sensor SW. For example, when the user sets the second recording medium D2 in a predetermined part of the main frame 2 and feeds the top end of the medium D2 toward the paper feeding roller members JR1 and JR2, the second recording medium D2 can be fed further forth. When the step motor SN is driven to regularly rotate, this regular rotation of the step motor SN is transmitted through the gear train GY to the both roller members JR1 and JR2 and the supporting member ST1 respectively, thus rotating them. The control unit CP continuously drives the step motor SN until the sensor SW detects the top end of the second recording medium D2. It is noted that the control pulse number of the step motor SN exactly corresponds to the feeding amount of the recording medium D2, unless feeding errors such as a zigzag feeding. The control unit CP controls, accordingly, the recording medium D2 to be fed by transmitting a predetermined number of pulses to the step motor SN.

A cutter unit KC for cutting the second recording medium D2 is disposed downstream of the roller member JR2. This cutter unit KC is operated timely to cut the recording medium D2 under feeding control. Any type of cutter unit KC, as long as it can cut the recording medium D2, may be used. For example, a type of cutter unit is to cut the second recording medium D2 with a blade KC1 (see FIG. 4(*a*)) reciprocating in the width direction of the recording medium D2 (in a lateral direction of FIG. 3), another is to cut the same with a different blade KC1 having a length substantially corresponding to the width of the recording medium D2, movable up and down.

Thereafter, the control unit CP conducts the following control operation in order to prevent the generation of white lines and extreme overlapping between portions recorded before and after the cutting operation.

Figure 26B:
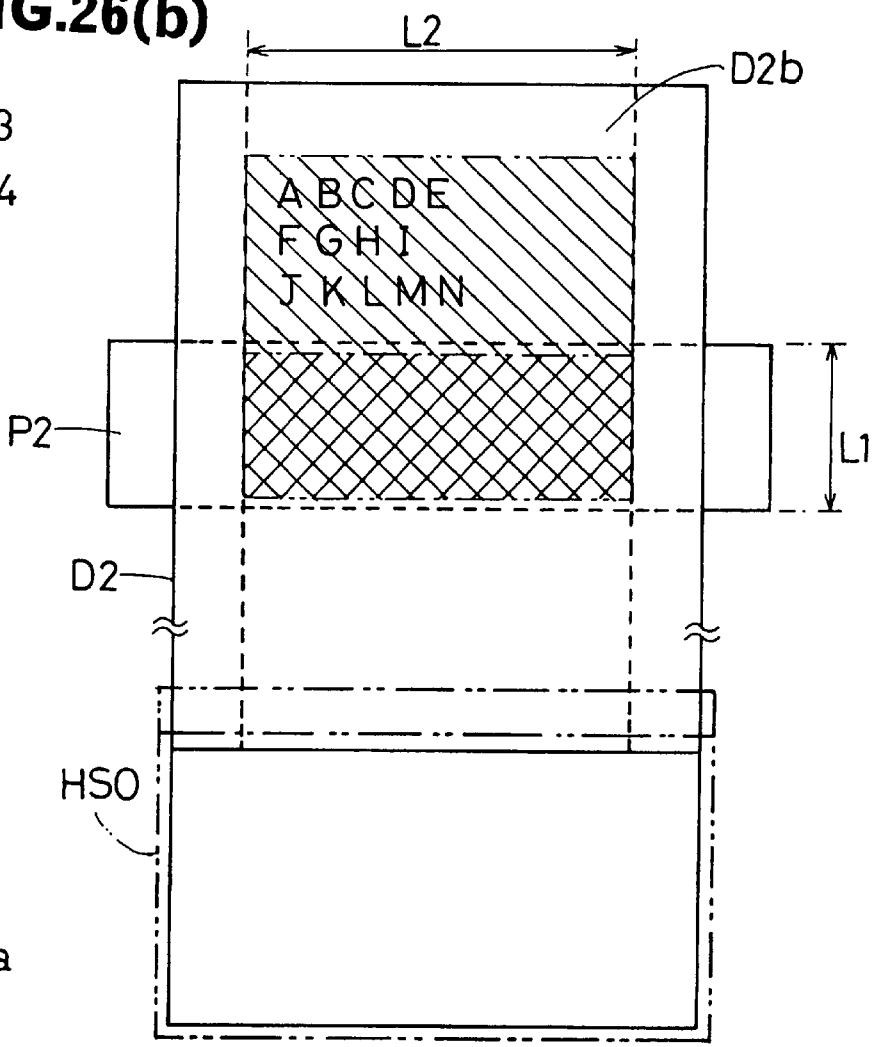
FIG. 26(*a*) is a side view showing a relation between a large-width recording medium and a recording head in the tape printing apparatus in the embodiment, to explain the feeding amount of the recording medium.
Figure 26A:
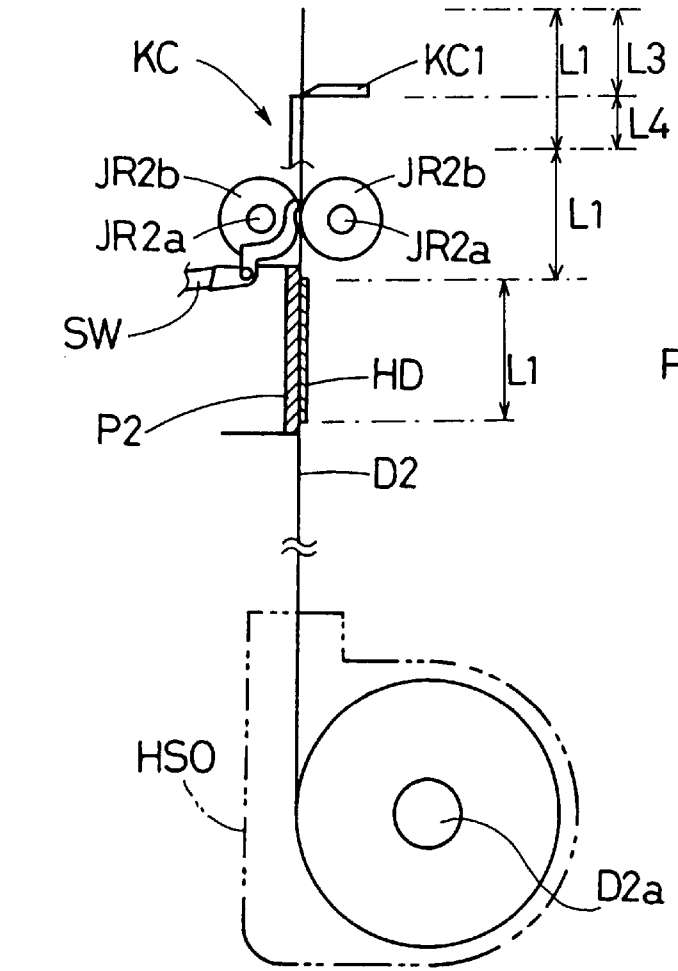

The control unit CP controls to feed the top end of the recording medium D2 by a length each, generally, corresponding to the arrangement row (L1) of the heating elements as shown in FIGS. 26(*a*) and (*b*) and to drive the recording head to record on the recording medium D2 after stopping it. At this time, the control unit CP controls the feeding operation just before a cutting operation with the cutting unit KC so as to feed the recording medium D2 by an amount (L3) less than the length L1 and, after the cutting operation, feed the same by a remaining amount L4 (=L1−L3). The recording head HD is driven again to record on the recording medium D2.

Concretely, the control unit CP drives the roller members JR1 and JR2 to rotate thereby to feed the top end of the recording medium D2 by the length L1 of the heating element row, stops feeding the recording medium D2 and drives the recording head HD to record through the ink ribbon IR on the recording medium D2 in a main scanning direction while driving the carriage moving mechanism CH to move the carriage CA in that direction. At that time, the control unit CP judges whether a recording operation is for the line of two lines before the time to cut the second recording medium D2. In the case of not recording on the line of two lines before a cutting time, the control unit CP drives the roller members JR1 and JR2 to feed the top end of the recording medium D2 by the length L1. In detecting that the recording operation is for the line of two lines before the time to cut the second recording medium D2, the control unit CP drives, after the recording operation on the line, to feed the recording medium D2 by the feeding amount L3 which is less than the length L1 of the heating element row.

Thereafter, the control unit CP drives the cutting unit KC to cut the top recorded portion of the recording medium D2 and feed the recording medium D2 by a remaining amount L4 (=L1−L3) to perform the next recording. Even if the recording medium D2 is pulled by the cutting unit CK and the like, causing backlash in the gear train GY and the like for feeding the recording medium D2, accordingly, it is sufficient to regulate the feeding amount corresponding to backlash in feeding the recording medium D2 by the remaining amount L4. As a result, white lines and large overlapping can be prevented from being generated between the recorded portions before and after the cutting operation.

It is noted that the judgement of the control unit CP as to whether the current recording is for the line of two lines before the time to cut the second recording medium D2 depends on only the positional relation between the cutting unit KC and the recording head HD and, therefore, the recording medium D2 may be fed by the cutting unit CK driven after the recording of other lines than the line of two lines before the cutting time. Particularly, in case of a mechanism of driving the cutting unit KC to feed the recording medium D2 by an amount more than a length corresponding to the backlash, it may be constructed so as to detect in advance the feeding amount more than a length corresponding to the backlash and regulate the feeding amount in feeding the recording medium D2 by the remaining amount.

Next, a structure of the carriage CA will be explained. The carriage CA can mount, on its mounting surface, selectively any one of the tape cassette TC accommodating the first recording medium D1 and the ink ribbon IR and others (see FIGS. 2, 5, and 7) and the ink cassette RC accommodating only the ink ribbon IR (see FIG. 8). On the back side of the carriage CA, a step motor SL (see FIGS. 3 and 6) is mounted. This step motor SL is used for feeding the ink ribbon IR and the like accommodated in the tape cassette TC mounted on the carriage CA and for making the recording head HD press the second recording medium D2 or release from the same during a recording processing in the wide station WS. The step motor SL is used as a driving power source for two purposes in order to effectively utilize the driving power of the step motor SL.

The recording head HD is mounted on the lower side of the carriage CA and, on its recording surface, is provided with a plurality of heating elements arranged in a row with a predetermined length (corresponding to a printing width L1 shown in FIGS. 4(*a*) and 4(*b*)), the heating elements being able to heat per dot. The tape feeding mechanism using the driving power of the step motor SL feeds the first recording medium (tape) D1 and others accommodated in the cassette TC mounted on the carriage CA toward the recording surface of the recording head HD in a direction orthogonal to the row of the heating elements. The heating elements melt ink of the ink ribbon IR to make the ink adhere per dot to the first recording medium D1.

Figure 7:
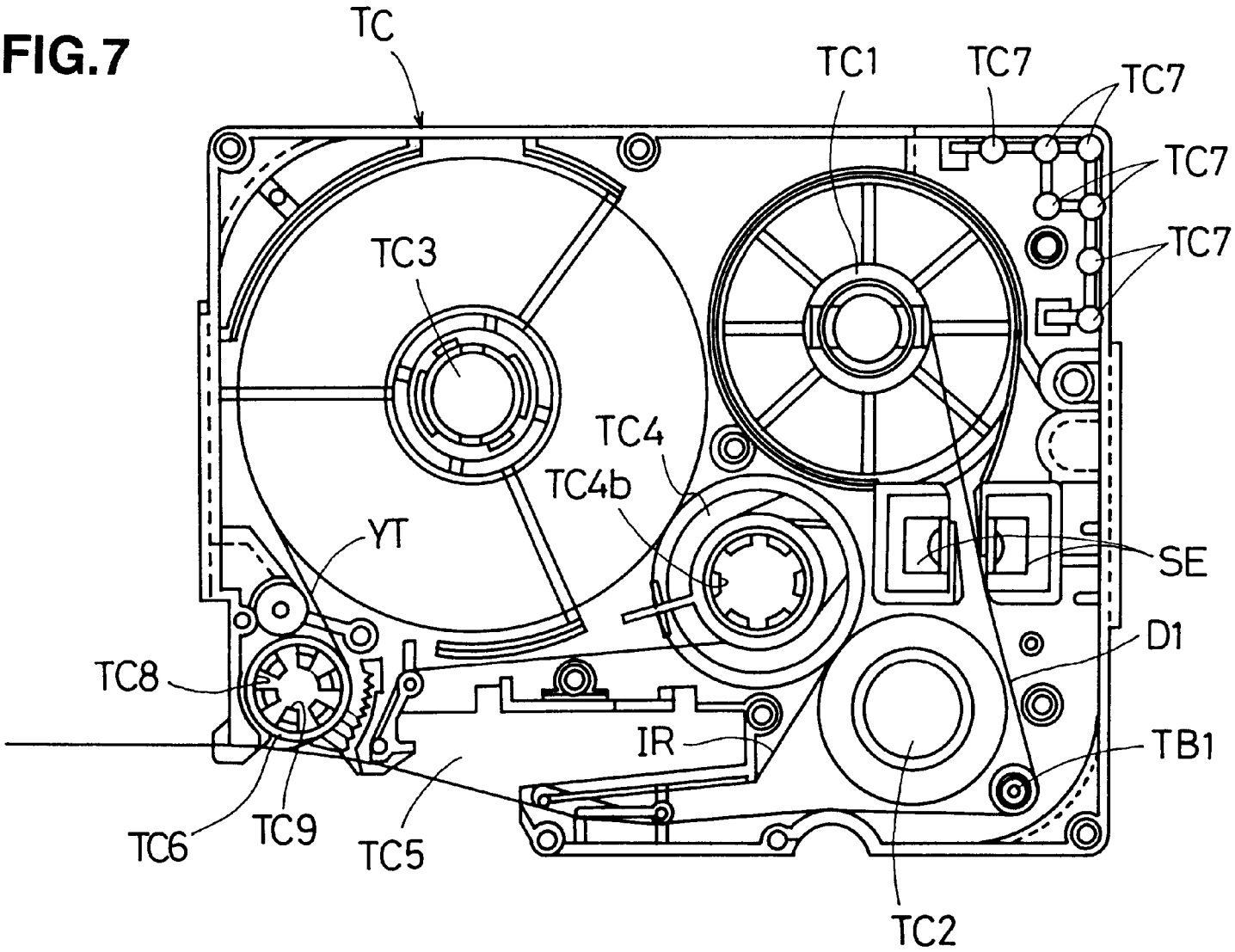
FIG. 7 is an enlarged front view of a tape cassette in the embodiment.
Figure 8:
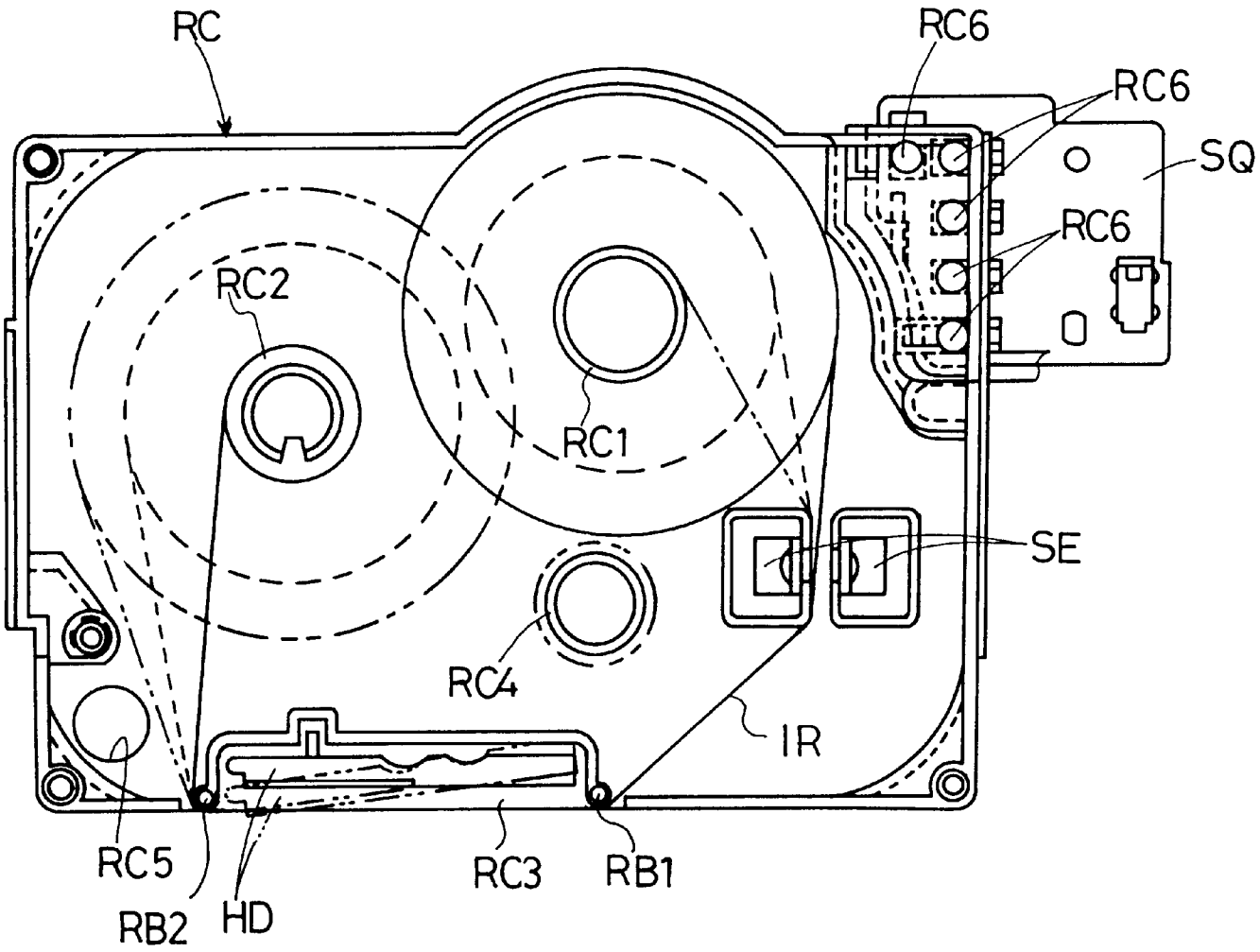
FIG. 8 is an enlarged front view of a ribbon cassette in the embodiment.

The tape cassette TC is, as shown in FIG. 7, constructed of a substantially rectangular cassette case which accommodates the first recording medium D1 to be used for a recording process in the tape station TS and the ink ribbon IR. The ribbon cassette RC is, as shown in FIG. 8, constructed of a substantially rectangular cassette case which accommodates only the ink ribbon IR to be used in the wide station WS, without any recording medium, differently from the tape cassette TC.

Figure 5:
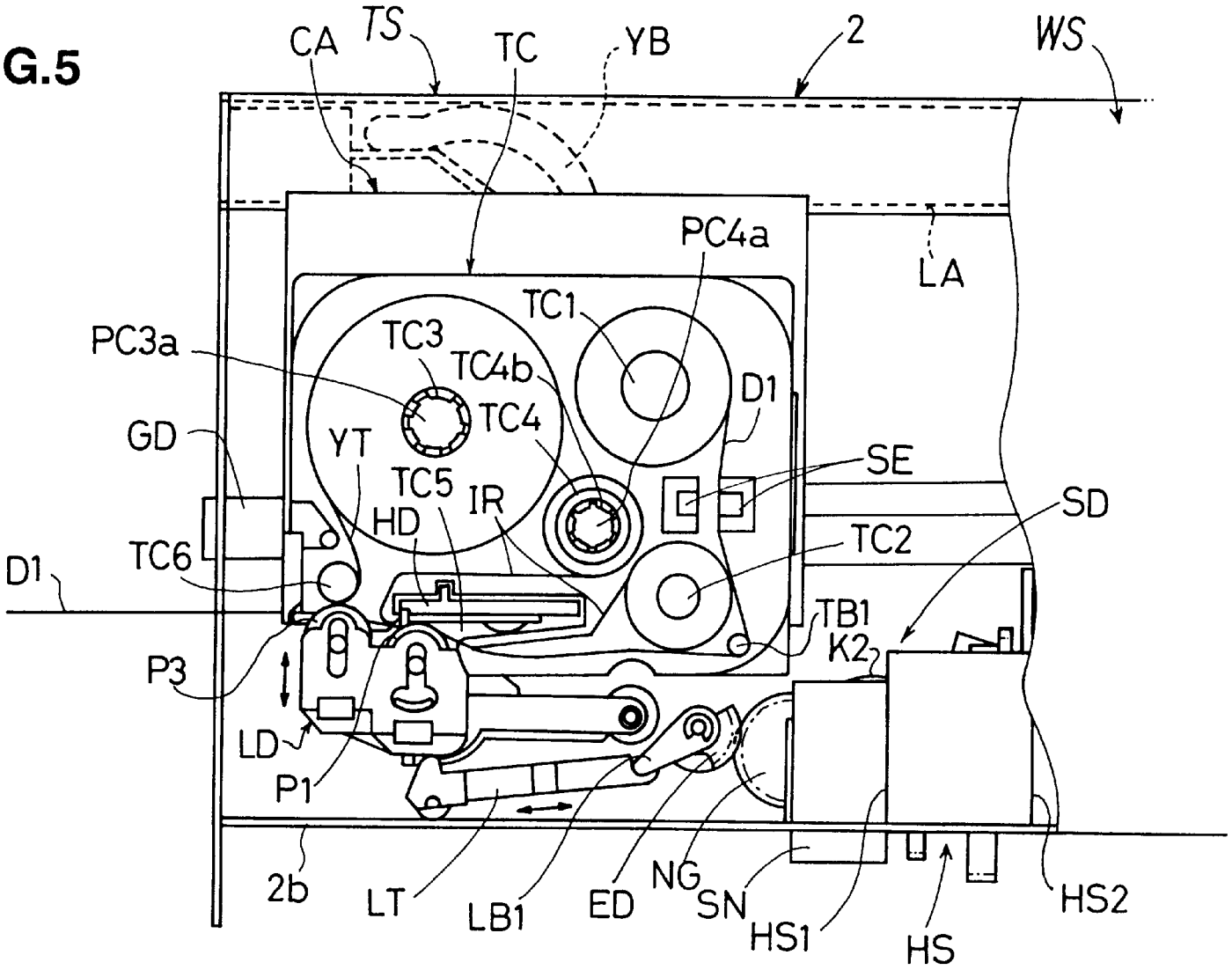
FIG. 5 is a partial enlarged front view of a tape station shown in FIG. 2.

Concretely, the tape cassette TC accommodates the first recording medium D1 formed of transparent tape and the like having a small width, the ink ribbon IR used for printing on the first recording medium D1, and a double-sided adhesive tape YT to be adhered to the back of the printed recording medium D1, those being wound on reels TC1, TC2, and TC3 respectively as shown in FIGS. 5 and 7. It is also provided with a reel TC4 for winding the used ink ribbon IR onto.

The unused ink ribbon IR wound on the reel TC2 is drawn therefrom and put on the first recording medium D1, and then fed into an open portion TC5 to pass between the recording head HD and the first platen P1. After that, the ink ribbon IR is separated from the first recording medium D1, and wound onto the reel TC4 driven by the step motor SL.

A cam member PC4*a* provided on the surface of the carriage CA is inserted in the reel TC4 of the tape cassette TC mounted on the carriage CA, and a driving cam follower TC4*b* is integrally fitted in the inside of the reel TC4, engaging with the cam member PC4*a*. Under the engagement of the driving cam follower TC4*b* and the cam member PC4*a*, the reel TC4 receives the driving power of the step motor SL through the gear train which will be described later, winding the used ink ribbon IR thereon.

The double-sided adhesive tape YT is accommodated in the tape cassette TC, which is wound on the reel TC3 with a releasable paper provided on the outside thereof. The double-sided adhesive tape YT drawn from the reel TC3 is made to pass between a tape driving roller TC6 and a joint roller P3 thereby to adhere an adhesive surface of the tape YT on which no releasable paper is provided to the first recording medium D1. Note that it is preferable to attach a double-sided adhesive tape one surface of which is provided with a releasable paper thereon to the back surface of the second recording medium D2.

The first recording medium D1 wound on the reel TC1 and drawn therefrom is fed between a pair of sensors SE for detecting a terminal end and a color of the medium D1 of the tape cassette TC and the ink ribbon IR of the ribbon cassette RC and via a guide pin TB1 into the opening portion TC5 of the tape cassette TC. Then, the first recording medium D1 is attached with the double-sided adhesive tape YT while passing between the tape driving roller TC6 rotatably disposed at a lower position in one side of the tape cassette TC, which is made to rotate by the driving power of the step motor SL, and the roller P3 disposed opposite to the roller TC6. The first recording medium D1 is discharged out of the tape cassette TC and then the main frame 2. At this time, the double-sided adhesive tape YT is adhered to the first recording medium D1 between both rollers TC6 and P3.

The roller P3 is supported in parallel with a first platen P1 on a roller holder LD. This roller holder LD can make the roller P3 press against or separate from the roller TC6, and the first platen P1 press against or separate from the recording head HD at the same time. Since the platen P1 is required to be rotatable in order to feed the recording medium D1, a cylindrical platen is preferably used.

The tape driving roller TC6 is provided with a through hole TC8 as shown in FIG. 7, in which a cam follower TC9 is formed. When a cam member PC6*b* (see FIG. 9) formed on the surface side of the carriage CA is inserted in the through hole 8, the cam member PC6*b* is engaged with the cam follower TC9. On the other hand, a cam member PC3*a* formed on the surface side of the carriage CA is inserted in the reel TC3. This reel TC3 is, however, provided therein with no cam follower rotatable integrally with the reel TC3, so that the reel TC3 only idles, not participating in the feeding of the double-sided adhesive tape Yt.

The ribbon cassette RC used for recording character images on a surface D2*b* (see FIG. 4(*b*)) of the second recording medium D2 during a recording process in the wide station WS accommodates a reel RC1 for winding thereon an unused part of ink ribbon and a reel RC2 for winding thereon a used part of the ink ribbon. With the rotation of the reel RC2, the ink ribbon IR drawn from the reel RC1 is passed between the sensors SE, and is fed to an open portion RC3 of the ribbon cassette RC via a guide member RB1 (see FIG. 8), finally is wound on the reel RC2 via a guide member RB2.

In a state that the ribbon cassette RC is set on the carriage CA, the cam members PC4*a* and PC6*b* both formed on the surface of the carriage CA are inserted into reels RC4 and RC5 respectively. These reels RC4 and RC5 of the ribbon cassette RC, differently from the tape cassette TC, are not provided with any cam follower being rotatable integrally with the reels RC4 and RC5. Accordingly, the cam member PC4*a* and the tape driving roller TC6 only idle in receiving the driving power of the step motor SL, providing no influence on the feeding of the ink ribbon IR. There is no necessary to especially stop driving the cam member PC4*a* and the roller TC6.

The color ink ribbon IR in the ribbon cassette RC is applied thereon with a plurality of inks, for example, Cyan (C), Magenta (M), Yellow (Y), etc. by a predetermined length each, namely by a recording area of a line L2 (see FIG. 4(*b*)), which are repeatedly arranged in that order. This is to make the recording head HD moving in the main scanning direction record on the second recording medium D2 with a single color by one line L2 through a part of the ink ribbon IR having any one color among magenta, cyan, and yellow in one line L2 length, and besides, with a mixed color by one line L2 through several parts of the ink ribbon IR. Note that a cross line shown in FIG. 4(*b*) represents an area where the part recorded by one line L2 length by the recording head HD. In this case, the recording medium D2 is recorded by one line through a part of the ink ribbon IR having any one color among magenta, cyan, and yellow, and then on the same line through a different part of the ink ribbon IR having a different color and, if necessary, on the same line through a further different part of the ink ribbon IR. Thus, if recording the same line area of the recording medium D2 by using different parts of the ink ribbon IR having different colors so as to be superimposed one after another, the images with a mixed color of cyan, magenta, and yellow such as red, blue, etc. can be recorded on the second recording medium D2.

Deference points between the tape cassette TC and the ribbon cassette RC are in that the position of the reels TC2 and RC1 for winding thereon unused ink ribbon and the position of the reels TC4 and RC2 for winding thereon used ink ribbon in addition to whether the double-sided adhesive tape YT and the first recording medium D1 are accommodated or not. Specifically, the position of the reel TC1 of the tape cassette TC corresponds to the position of the reel RC1 of the ribbon cassette RC, and the position of the reel TC3 for the double-sided adhesive tape YT corresponds to the reel RC2 of the ribbon cassette RC. This is because it is sufficient if only the tape cassette TC for a single color recording accommodates the ink ribbon IR of a single color, having a length corresponding to that of the first recording medium (tape) D1, while the ribbon cassette RC for a multicolor recording is needed to accommodate the ink ribbon having a length three times or more as the length of a recording area because the ink ribbon IR is required to have three parts each having any one color of cyan, magenta, yellow, etc., for example, by a predetermined length each (namely, by one line). If the ribbon cassette RC is used for a single color recording, it is not necessary to apply three colors such as cyan, magenta, and yellow on the ink ribbon IR.

Consequently, if both the cassette TC and RC are formed to accommodate an ink ribbon in substantially the same position, each accommodating efficiency of the cassette TC and RC is deteriorated and a wastefully larger cassette case is needed, which is not desirable in view of the cost of the cassettes TC and RC and the increased size of the main frame 2. Accordingly, the cassettes TC and RC used for the recording stations TS and WS respectively are constructed as shown in FIGS. 7 and 8 so that internal components be efficiently arranged without obstructing each other.

In order to distinguish two cassettes mentioned above, each of the tape cassette TC and the ribbon cassette RC is provided with a plurality of marks (seven marks, for example) TC7 or RC6 at a right upper portion of the cassette. Those marks TC7 and RC6 are formed to be concave or not, which indicate a distinction between the tape cassette TC and the ribbon cassette RC. Additionally, the marks TC7 of the tape cassette TC indicate a width of the first recording medium D1 and the marks RC6 of the ribbon cassette RC indicate a type of color, i.e., single or multiple. As shown in FIG. 8, a sensor SQ detects as to whether the marks TC7 or RC6 are concave, so that the control unit CP can detect a distinction between the two cassettes TC and RC, the width of the first recording medium D1, and the color of the ink ribbon of the ribbon cassette RC, i.e., single or multiple.

The sensor SE is set to detect yellow ink of the ink ribbon IR in the ribbon cassette RC. When a yellow ink portion of the ink ribbon IR is fed to a front of the sensor SE, the control unit CP can detect the part to be yellow. Accordingly, in a multicolor recording process, the control unit CP detects the start end of the yellow ink portion to feed precisely the ink ribbon IR having each color, cyan, magenta, yellow, by a predetermined length L2 each, preventing the recording head HD from recording images with incorrect color. On the other hand, in case of a single color ink ribbon, the ink ribbon is applied on its entire base material with ink of a single color such as black and on the terminal end portion with a sensing mark (not shown). When the sensor SE detects the sensing mark, therefore, the control unit CP receives a detected signal from the sensor SE and distinguishes the terminal end portion of the ink ribbon IR.

Next, explanation is made in relation to a mechanism for winding the ink ribbon IR accommodated in the ribbon cassette RC used for a recording operation in the wide station WS, referring to FIGS. 9 through 13. Note that FIGS.

Figure 9:
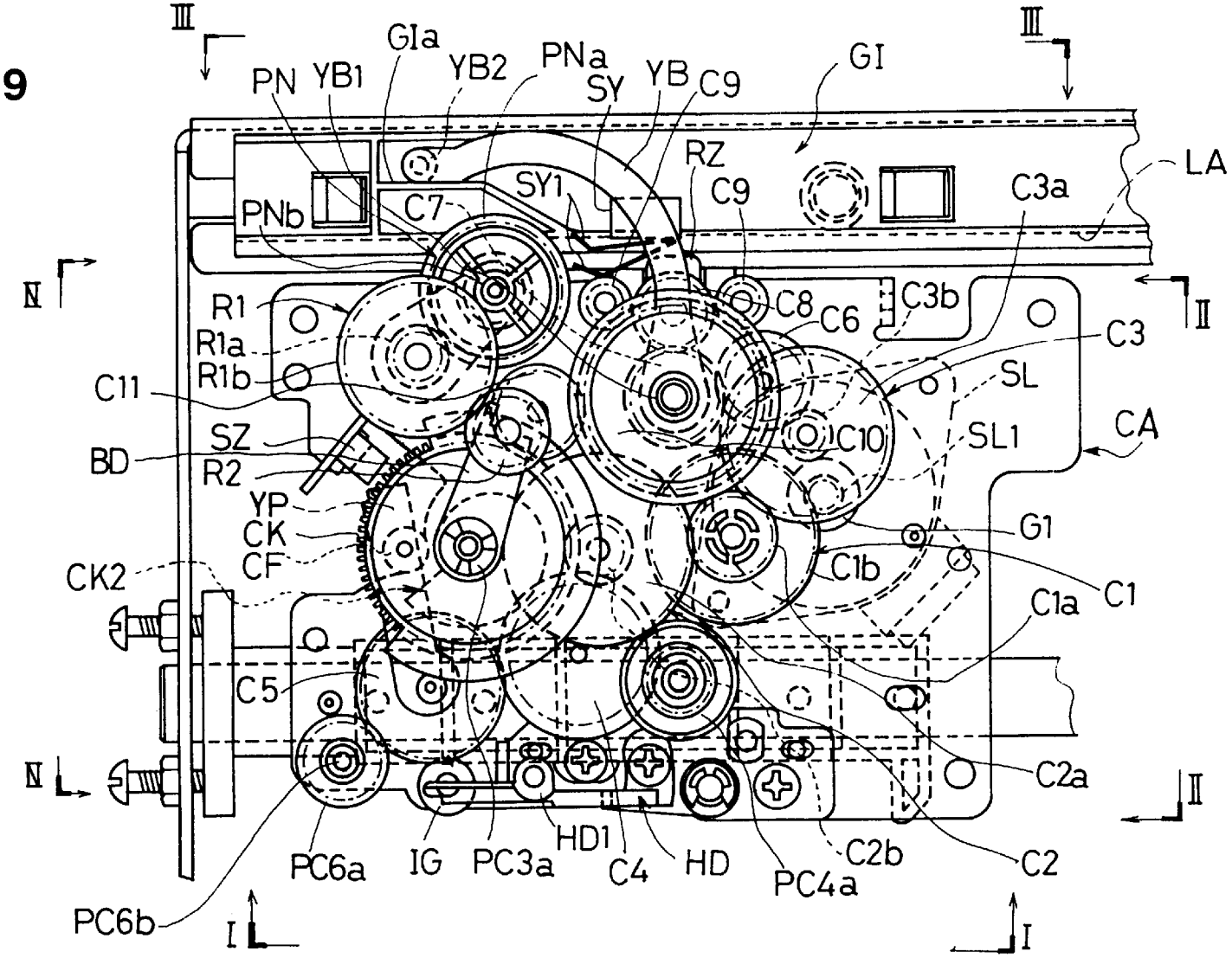
FIG. 9 is an enlarged front view of a carriage in the embodiment.

10 through 13 are views of the carriage CA viewed along arrows I—I, II—II, III—III, and IV—IV respectively in FIG. 9, those figures being modified to simplify the explanation of the positional relation between components by shifting the positions of components from their actual positions, also omitting some components. The components shown in FIG. 9 therefore do not correspond to those in FIGS. 10–13. For example, a pinion PN in FIG. 9 is disposed in an actual position, while the pinion PN and a swing lever YB in FIGS. 10–13 are shifted from the actual position so as to easily find the gear C11 and others in the figures. Furthermore, the sensor SZ and the cam follower CF and the like are not shown in FIG. 13 to clearly show the gear C11 and others.

A pinion PN is provided on the carriage CA at its upper side as shown in FIG. 9. This pinion PN is meshed with a rack LA (see FIG. 5) provided in a lateral direction in FIG. 2, corresponding to a length of the timing belt TB. With the movement of the carriage CA, the pinion PN is rotated by the rack LA, transmitting the rotational power to the gears R1 and R2 mentioned later, thus rotating the reel RC2 in the ribbon cassette RC to wind used ink ribbon IR thereon.

Figure 11:
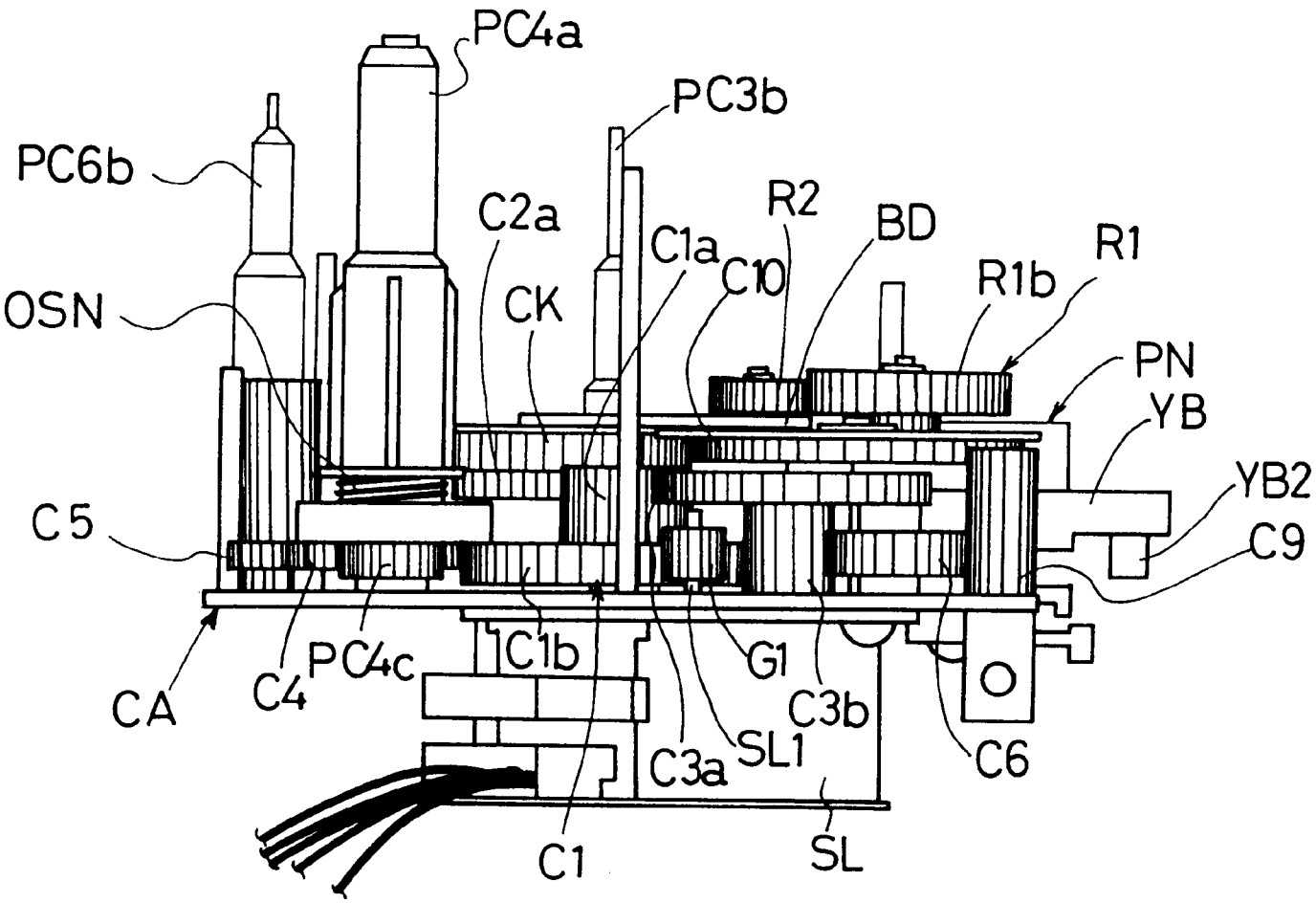
FIG. 11 is a side view of the main components viewed along II—II line of FIG. 9.
Figure 12:
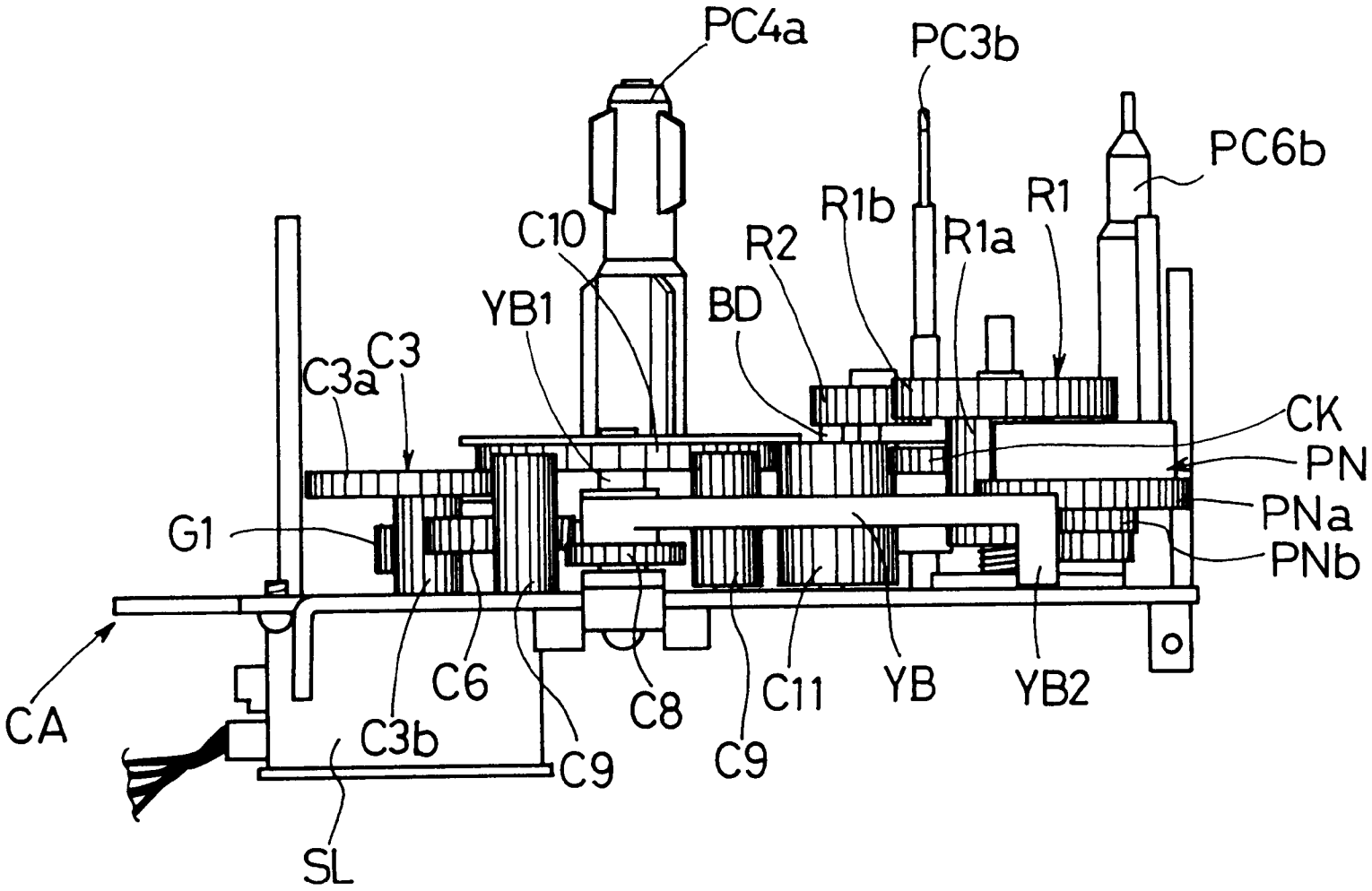
FIG. 12 is a side view of the main components viewed along III—III line of FIG. 9.
Figure 13:
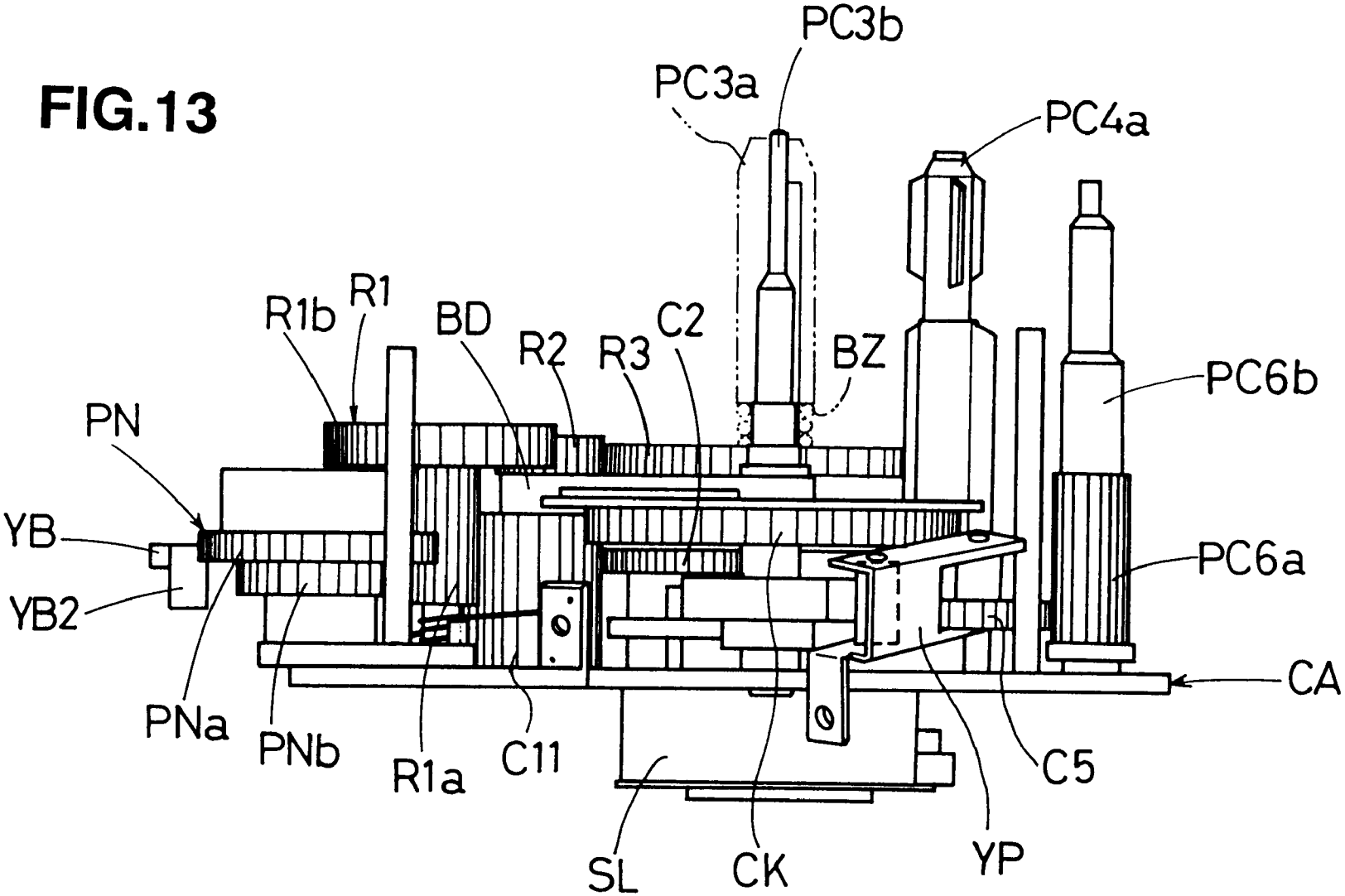
FIG. 13 is a side view of the main components viewed along IV—IV line of FIG. 9.

The pinion PN comprises a large diameter gear PN*a* and a small diameter gear PN*b* arranged in tiers (see FIGS. 12 and 13). The small diameter gear PN*b* is meshed with the rack LA. The large diameter gear PN*a* is meshed with a small diameter gear R1*a* of a first winding gear R1 comprising the small diameter gear R1*a* and a large diameter gear R1*b*. The cam member PC3*a* which is to be inserted in the reel TC3 or RC2 is provided to cover the rotating shaft PC3*b* as shown by an imaginary line in FIG. 13 (not shown in FIGS. 9–12). To this rotating shaft PC3*b*, attached is a swing bar BD which swings about the rotating shaft PC3*b*. A second winding gear R2 is rotatably attached to the tip end of the swing bar BD so that it is meshed or not with the large diameter gear R1*b* of the first gear R1 according to the swinging of the swing bar BD. This is to make the reel RC2 of the ribbon cassette RC wind the ink ribbon IR during a recording operation while the carriage CA is moved forward (in a rightward direction in FIG. 2) in the wide station WS. Thus, the second gear R2 is meshed with the large diameter gear R1*b* thereby to rotate the cam member PC3*a* by the driving power produced by the rotation of the pinion PN. To the contrary, the gear R2 is positioned not to mesh with the large diameter gear R1*b* during a non-recording operation while the carriage CA is moved backward (in a leftward direction in FIG. 2), because it is necessary that the driving power by the pinion PN is not transmitted to the gear R2 in order to prevent the ink ribbon IR from being wound.

When the gear R2 is meshed with the large diameter gear R1*b*, the gear R2 is also meshed with the gear R3 (shown only in FIG. 13) rotatably supported on the rotating shaft PC3*b*, making the gear R3 rotate to wind the ink ribbon IR. With the rotation of this gear R3, a spring BZ shown by an imaginary line in FIG. 13 mounted on the gear R3 generates torque to rotate the cam member PC3*a*, thus winding the ink ribbon IR.

Figure 10:
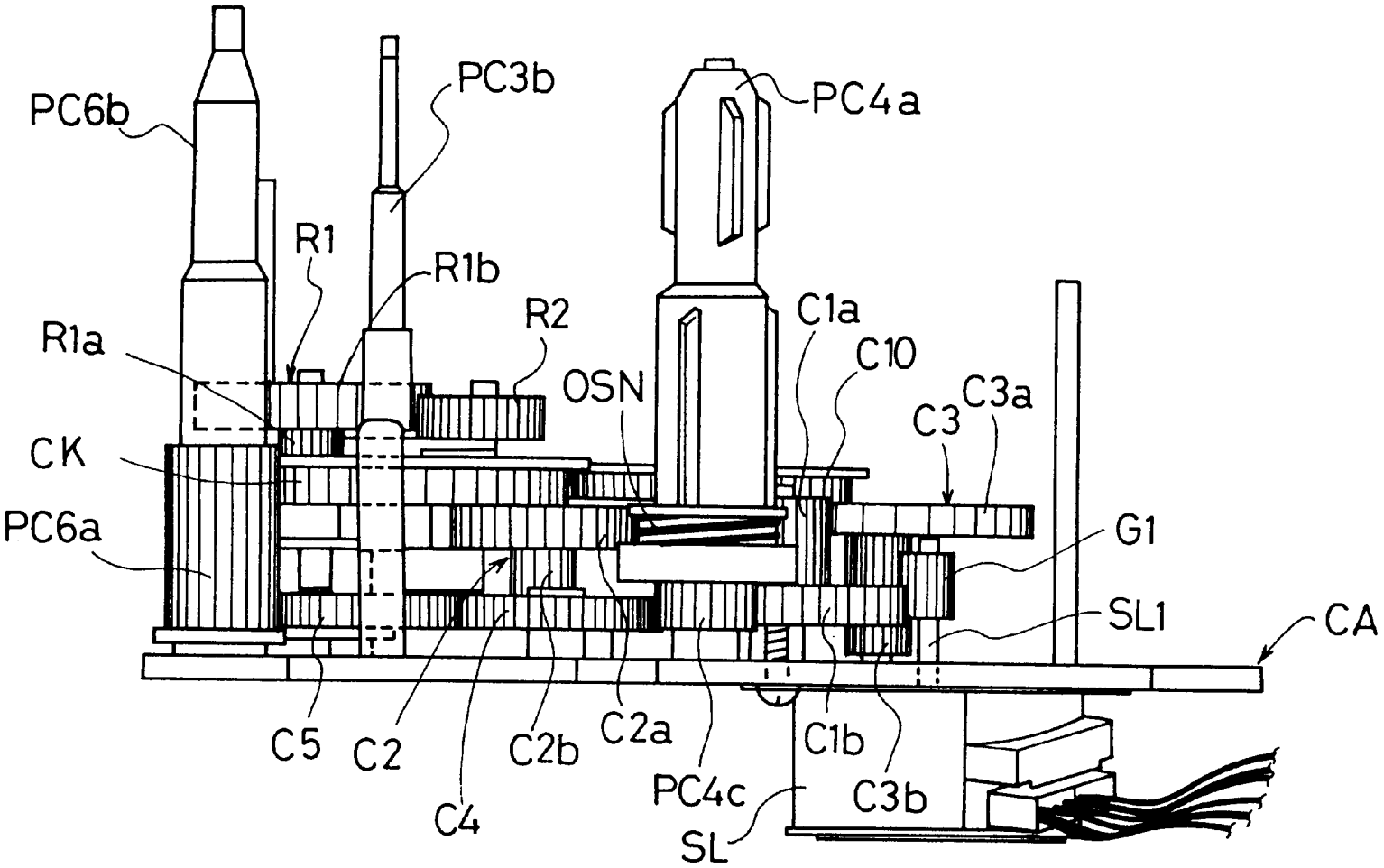
FIG. 10 is a side view of main components mounted on the carriage, viewed along I—I line of FIG. 9.

A mechanism for feeding the ink ribbon IR accommodated in the tape cassette TC during the recording operation in the tape station TS will be explained hereinafter. On the back side of the carriage CA, the step motor SL serving as a driving motor as mentioned above is fixedly mounted. As shown in FIGS. 9, 10 and 11, the driving shaft SL1 of the step motor SL is provided so as to extend through an through hole of the carriage CA to its surface side. A gear G1 is mounted on the end portion of the driving shaft SL1. On the surface side of the carriage CA, gears C2 and C3 and others mentioned later are rotatably mounted, forming a gear train for feeding the ink ribbon. The driving power of the driving shaft SL1 is transmitted to carriage gears C1, C2, C4, and PC4*c* in order to rotate the driving cam follower PC4*a* for winding the ribbon IR, and to the gears C1, C2, C4, C5, and PC6*a* in order to rotate the cam member PC6*b* for feeding the tape (the first recording medium D1).

More specifically, the first gear C1 rotatably mounted on the surface of the carriage CA is constructed of a small diameter gear C1*a* and a large diameter gear C1*b* arranged in tiers as shown in FIGS. 9 and 11. The large diameter gear C1*b* is meshed with the gear G1 which rotates integrally with the driving shaft SL1. The second gear C2 and the third gear C3 are rotatably mounted on the carriage CA at a left and a right upper sides respectively (see FIG. 9) with respect to the small diameter gear C1*a* disposed on the large diameter gear C1*b* in FIG. 10.

The second gear C2 serves to transmit the driving power for feeding the tape of the tape cassette TC to the fourth gear C4 connected to the second gear C2. The gear C2 is constructed of a large diameter gear C2*a* and a small diameter gear C2*b* disposed in tiers as shown in FIGS. 9 and 10. This large diameter gear C2*a* is meshed with the small diameter gear C1*a* of the first gear C1. The small diameter gear C2*b* disposed underneath the larger diameter gear C2*a* (see FIG. 10) is meshed with the fourth gear C4 rotatably mounted on the surface of the carriage CA.

At the side of this fourth gear C4, as shown in FIGS. 9 and 10, a cam member PC4*a* used for a tape feeding operation, insertable into the reel TC4 for winding a used ink ribbon IR in the tape cassette TC. The fourth gear C4 is meshed with a gear PC4*c* disposed underneath the cam member PC4*a*, and with a fifth gear C5 arranged at the left side of the fourth gear C4. The fifth gear C5 is meshed with an idle gear IG disposed at a recording head HD side of the fifth gear C5. At the side of the fifth gear C5 is provided a cam member PC6*b* insertable into the tape driving roller TC6 for pressing the first recording medium D1 and the double-sided adhesive tape YT. A gear PC6*a* is disposed underneath the gear PC6*a* and meshed with the fifth gear C5.

Accordingly, when the driving shaft SL1 of the step motor SL is rotated clockwise (or counterclockwise) in FIG. 9, rotating the first gear C1 counterclockwise (clockwise), the second gear C2 clockwise (counterclockwise), the fourth gear C4 counterclockwise (clockwise), the fifth gear C5 clockwise (counterclockwise), and the gear PC6*a* counterclockwise (clockwise), to rotate the driving cam member PC6*b* counterclockwise (clockwise) and the gear PC4*c* clockwise (counterclockwise) respectively.

With the above structure, the counterclockwise rotation of the gear PC4 causes a spring OSN attached at a lower portion of the cam member PC4*a* to generate torque based on a clamping function, making the reel TC4 of the tape cassette TC set on the carriage CA wind the used ink ribbon IR on the reel TC4. On the other hand, the clockwise rotation of the gear PC4*c* causes the spring to be loosen, preventing the reel TC4 from winding the ink ribbon IR.

Note that the idle gear IG is meshed with a gear not shown attached rotatably to the platen P1 when the roller holder LD is moved toward the tape cassette TC to make the platen P1 come into contact with the recording head, thereby to rotate the platen P1.

Meanwhile, the rotation of the third gear C3 is utilized to transmit the driving power for pressing or releasing the recording head HD against or from the platen P2 during a recording operation in the wide station WS . This driving power is transmitted through the gears C3, C6, C7, C8, C9, C10, and C11 in that order, finally to a head driving cam gear CK. The third gear C3 is, more specifically, constructed of a large diameter gear C3*a* and a small diameter gear C3*b* arranged in tiers as shown in FIGS. 9, 10, and 12. This large diameter gear C3*a* is meshed with the small diameter C1*a* of the first gear C1, while the small diameter gear C3*b* is meshed with the sixth gear C6 rotatably attached to the surface of the carriage CA.

On the left side of the sixth gear C6, as shown in FIGS. 9, 11 and 12, a swing lever YB is disposed. This lever YB is formed in the shape of an arc extending toward the outside of the carriage CA (i.e., upward in FIG. 9) and is rotatable about a rotating shaft YB1 inserted in the base portion of the swing lever YB. A seventh gear C7 is rotatably attached between the swing lever YB penetrating the rotating shaft YBi and the carriage CA. This gear C7 is meshed with the sixth gear C6 and also with the eighth gear C8 rotatably attached to the swing lever YB at a base portion thereof. At both sides of this eighth gear C8, slightly separately therefrom, a pair of ninth gears C9 and C9 are rotatably attached as shown in FIGS. 9 and 12. These gears C9 are arranged so that the eighth gear C8 is meshed with any one of the ninth gears C9 or is not meshed with any ninth gears C9 according to the swinging of the swing lever YB about the rotating shaft YB1.

When the eighth gear C8 is not meshed with any ninth gear C9, it is in the middle position between the two ninth gears C9 and C9. The eighth gear C8 is located in this position when an upper end portion YB2 of the swing lever YB is on an upper step GI*a* of the guide member GI in an upper left side of FIG. 9, where the upper step GI*a* serves as a holding means. At this time, the driving power of the step motor SL is transmitted through the gears C3, C6, and C7 to the gear C8, and not to the gears 9. As a result, when the carriage CA is in the above position, namely, in the tape station TS, the driving power of the step motor SL does not cause a pressing/separating operation between the recording head HD and the platen P1.

The eighth gear C8 is meshed with one of the two gears C9 when the carriage CA is moved in a right direction in FIG. 2, moving the upper end portion YB2 of the swing lever YB down from the upper step GI*a* along the guide member GI, to the wide station WS side, and the swing lever YB is inclined a little rightward by the driving power transmitted via the above gears from the step motor SL rotating clockwise, the eighth gear C8 being meshed with the right ninth gear C9, or the swing lever YB is inclined a little leftward by the driving power similarly transmitted from the step motor SL rotating counterclockwise, the eighth gear C8 being meshed with the left ninth gear C9. In these both cases, the driving power of the step motor SL is transmitted to the gear C9 and the following gears.

It is noted that the gear C8 is meshed with any one of the right and left gears C9 according to the rotating direction of the step motor SL, thereby transmitting the driving power of the motor SL to the gear C9 meshed with the gear C8, so that the driving power caused by the rotation in both directions of the motor SL can be efficiently utilized. In the case that two operations are made using one motor in the above manner, the motor is generally rotated in only one direction to perform each operation. It was sufficient to selectively make that the gear C8 supported on the swing lever YB mesh or not with a gear C9 in accordance with the rotation of the swing lever YB in one direction. In the embodiment, however, utilizing the driving of the step motor SL in both directions, the swing gear, i.e., the eighth gear C8 tends to escape from the gear C9 when the motor SL is rotated in one direction, preventing the driving of the gear C9. Therefore engaging gears, i.e., the ninth gears C9 and C9 are provided at both sides of the swing lever YB respectively to prevent the eighth gear C8 from escaping from the ninth gear C9. The eighth gear C8 can be meshed with any one of the two gears C9 when the swing lever YB is swung in a right and left directions along with the eighth gear C8. When the swing lever YB and the eighth gear C8 are not swung, alternatively, the eighth gear C8 can be put in a neutral state where it is not meshed with any ninth gears C9 according to the position of the ninth gears C9.

The two ninth gears C9 are also meshed with the tenth gear C10. This tenth gear C10 is rotatably mounted on the rotating shaft YB1 above the swing lever YB in the FIG. 12 and is meshed with the eleventh gear C11. This gear C11 is meshed with a head driving cam gear CK which is rotatably about the rotating shaft PC3*b*.

Accordingly, when the driving shaft SL1 of the step motor SL is rotated clockwise (or counterclockwise) in FIG. 9, rotating sequentially the first gear C1 counterclockwise (clockwise), the third gear C3 clockwise (counterclockwise), the sixth gear C6 counterclockwise (clockwise), the seventh gear C7 clockwise (counterclockwise), the eighth gear C8 counterclockwise (clockwise), the ninth gear C9 clockwise (counterclockwise), the tenth gear C10 counterclockwise (clockwise), and the eleventh gear C11 clockwise (counterclockwise), the head driving cam gear CK is rotated counterclockwise (clockwise).

Figure 17:
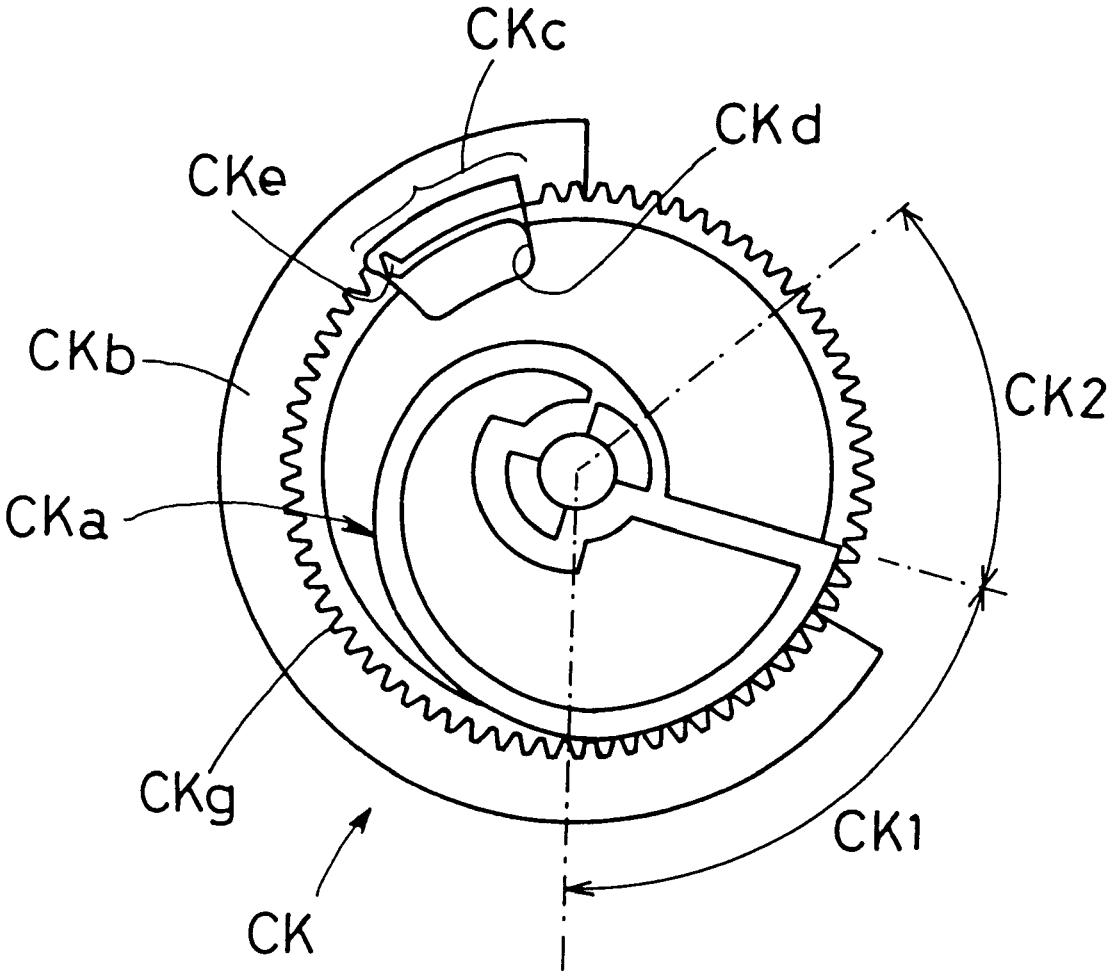
FIG. 17 is an enlarged front view of a head driving cam gear in the embodiment.

A head driving cam CK*a* is integrally provided on a lower surface of the gear CK, namely, a surface opposite to the carriage CA, which is used for pressing or releasing the recording head HD against/from the platen P2. This cam CK*a* comprises a large diameter portion CK1 and a small diameter portion CK2 as shown in FIG. 17.

The head driving cam CK*a* is supported at its peripheral surface with a swing lever YP so as to make a cam follower CF be in contact with the peripheral surface. When this cam follower CF is in contact with the large diameter portion CK1 of the cam CK*a*, the recording head HD is made to press against the platen P2. On the other hand, when the cam follower CF is in contact with the outer periphery of the small diameter portion CK2, the recording head HD is released from the platen P2. The recording head HD is thus rotatably about an supporting axis HD1 as shown in FIGS. 15 and 16, and can be pressed against and released from the platen 2.

Figure 15:
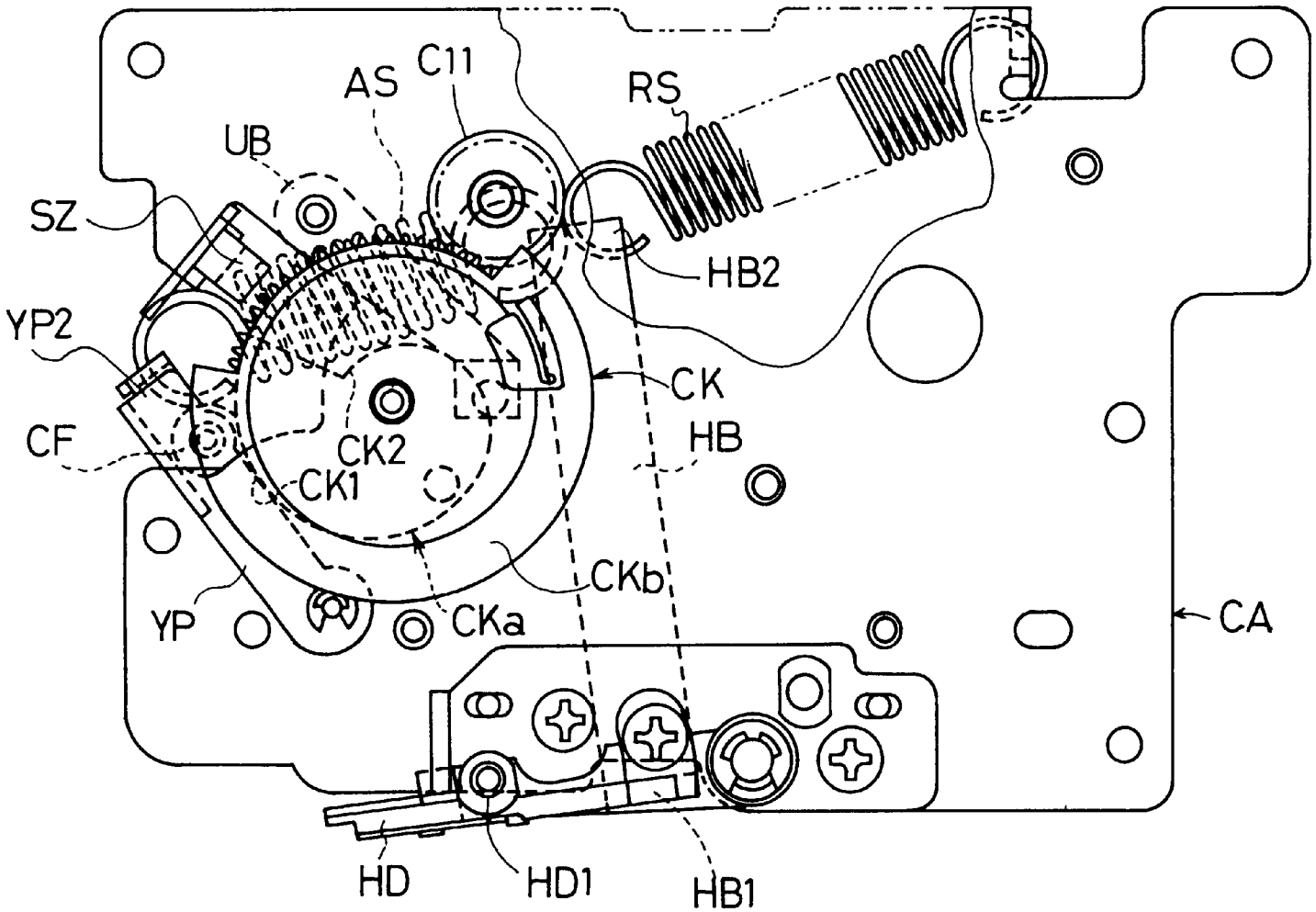
FIG. 15 is an enlarged front view of the carriage of FIG. 9 from which gears and others are removed, showing a state of a recording head being pressed against a platen.
Figure 16:
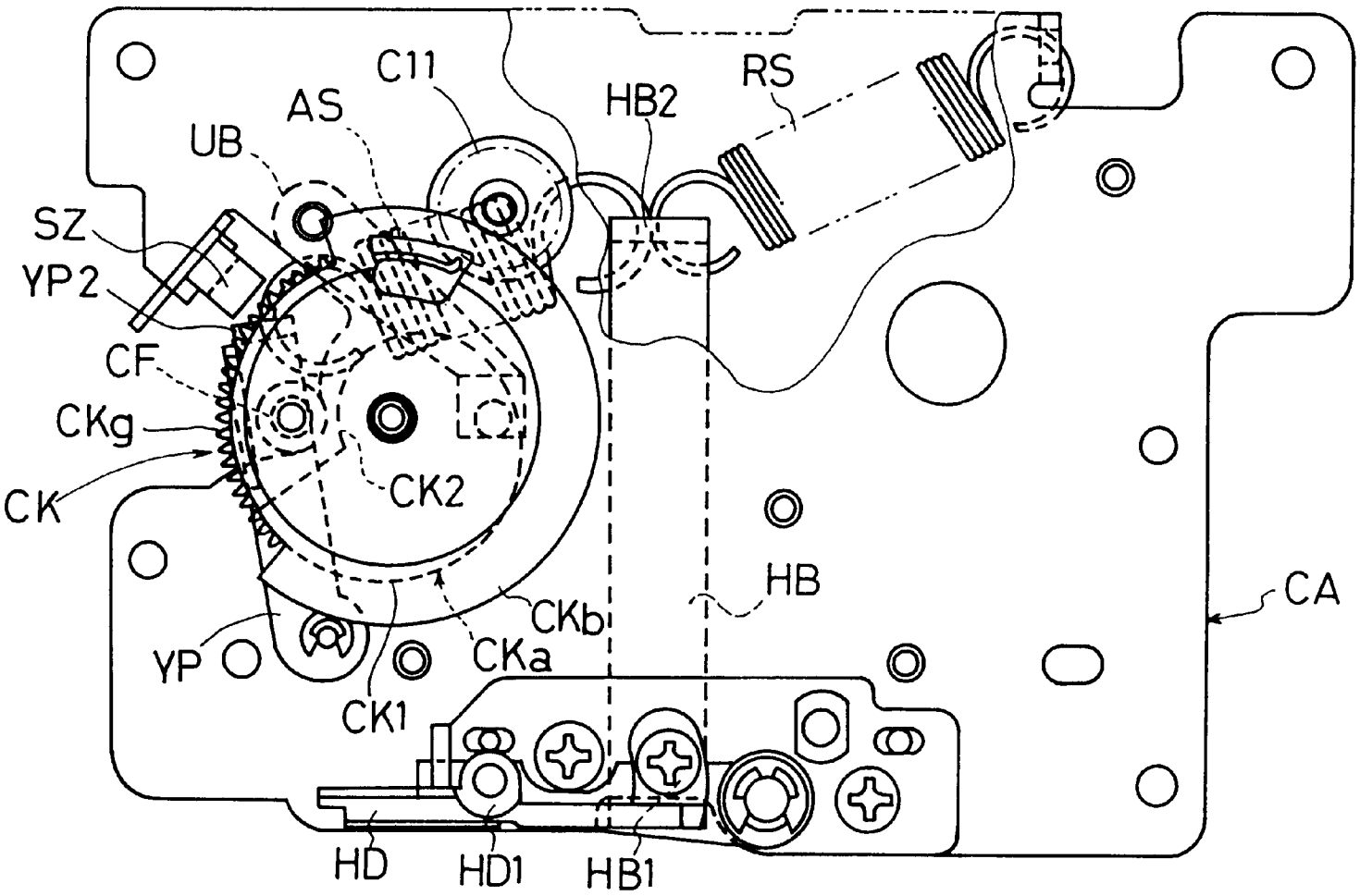
FIG. 16 is an enlarged front view of the carriage of FIG. 9 from which gears and others are removed, showing a state of the recording head being released from the platen.

A press/release member HB is provided on the back surface of the carriage CA as shown in FIGS. 15 and 16. A lower end portion HB1 of the press/release member HB is connected with the base portion of the recording head HD. An upper end portion HB2 of the press/release member HB is connected with each of two springs AS and RS serving for a release and press operations respectively. The spring AS is coupled with an end YP2 of the swing lever YP and the spring RS with the carriage CA at the upper right side in FIGS. 15 and 16.

When the cam follower CF is in contact with the large diameter portion CK1 of the head driving cam CK*a*, as shown in FIG. 15, the spring AS attached on the back surface of the carriage CA is largely stretched, beyond the tensile strength of the spring RS, thereby pulling the upper end portion HB2 of the member HB toward the head driving cam gear CK side. With the upward movement of the lower end portion HB1, consequently, the recording head HD is rotated counterclockwise about the supporting axis HD1, coming into contact under pressure with the platen P2. On the other hand, when the cam follower CF is in contact with a portion close to the small diameter portion CK2, the spring AS is not stretched, the tensile strength of the spring AS balancing with that of the spring RS.

Consequently, the upper end portion HB2 of the press/release member HB is separated from the head driving cam gear CK as shown in FIG. 16, moving the lower end portion HB1 downward, so that the recording head HD is rotated clockwise about the supporting axis HD1, separating from the platen P2. As above, the press/release member HB constructs means for pressing or releasing the recording head HD against or from the platen 2. Note that FIGS. 15 and 16 show the carriage CA on which most of the gears mentioned above are not mounted to clearly show the relation among the driving cam gear CK, the eleventh gear C11, and both springs RS and AS and others.

As mentioned above, the driving cam gear CK serves as a member for receiving the driving power of the step motor SL and transmitting that driving power to another member, i.e., the cam follower CF. This gear CK is provided on its periphery with tooth CK*g* meshing with the eleventh gear C11 and a guard portion CK*b* covering about two-third of the tooth CK*g*. The sensor SZ of transmission type for detecting whether the guard portion CK*b* exists or not is provided on the carriage CA at its upper left side in FIG. 9. This sensor SZ, detecting the guard portion CK*b*, serves to detect the starting point during a press/release operation between the recording head HD and the platen P2. It is noted that FIG. 17 is a view of the head driving cam gear CK of FIGS. 15 and 16, viewed from back.

More specifically, while the head driving cam gear CK shown in FIG. 16 being rotating counterclockwise to a position shown in FIG. 15, that is, the cam follower CF moving between the small diameter portion CK2 and the large diameter portion CK1, the guard portion CK*b* of the cam gear CK exists in the detecting point of the transmission type of sensor SZ, thereby blocking the transmission of light of the sensor SZ. When the recording head HD is in a contact position (the stop end portion of the large diameter CK1 of the cam follower CF) with the platen P2 or a separate position from the platen P2 (the small diameter portion CK2 of the cam follower CF), the guard portion CK*b* is out of the detecting point, allowing the transmission of light of the sensor SZ. The position of the guard portion CK*b* does not always correspond to the positions of the large and small diameter portions CK1 and CK2 of the cam gear CK because the position at which the sensor SZ detects the guard CK*b* is displaced.

In the above condition, if the sensor SZ detects only whether the guard portion CK*b* exists or not, i.e., blocking or transmitting, in detecting the starting point for pressing/releasing the recording head HD, it can not judge where the head driving cam gear CK exists, namely, in a press/release position or between both positions. That is to say, the control unit CP can not distinguish whether the head HD is in contact with or away from the platen P1 when the guard portion CK*b* does not exist in the detecting point of the sensor SZ, i.e., in a transmission condition, and further whether the head HD is moving from the pressing position to the release position or the reverse when the guard portion CK*b* exists in the detecting point.

Therefore a part where the tooth CK*g* does not exist, namely, a non-tooth portion CK*c* is provided at an area where the guard portion CK*b* is formed in the peripheral tooth CK*g* of the head driving cam gear CK, as shown in FIG. 17. In this non-tooth portion CK*c*, the eleventh gear C11 is meshed with the peripheral tooth CK*g*. The head driving cam gear CK serving as a driving power transmitting member is thus provided with the non-tooth portion CK*c* serving as a non-transmitting part at which the driving power of the step motor SL is not transmitted to other components. The cam gear CK is allowed to rotate until the eleventh gear C11 reaches the non-tooth portion CK*c*, and prevented from further rotating when the gear C11 comes to the non-tooth portion CK*c* by the rotation of the cam gear CK in a clockwise direction in FIG. 17 (a counterclockwise direction in FIGS. 15 and 16). The cam gear CK can not be rotated even if the control unit CP applies more pulses than required to the step motor SL accordingly, and the guard portion CK*b* is in the detecting point of the sensor SZ of transmission type, not putting the sensor SZ in a transmissible condition.

To the contrary, when the cam gear CK is rotated in a counterclockwise direction in FIG. 17 (a clockwise direction in FIGS. 15 and 16), the guard portion CK*b* is shifted from a blocking state where it exists in the detecting point of the sensor SZ to a transmitting state where it does not exist in the detecting point. As a result, the control unit CP can distinguish the rotating direction of the cam gear CK. When the control unit CP applies pulses more than the predetermined number to the step motor SL to rotate the cam gear CK in a direction to release the recording head HD, the non-tooth portion CK*c* of the cam gear CK works. This position is the starting point for the control of a pressing/releasing operation with respect to the recording head HD. Accordingly, if detects the rotating direction of the cam gear CK and the starting point for press/release control, the control unit CP can determine how much pulses from the starting point should be applied to the step motor SL to press/release the recording head HD against/from the platen P2, or whether the recording head HD is in moving from the press position to the release position or the reverse.

It is consequently required to detect the starting point for the press/release control with respect to the recording head HD in driving the tape printing apparatus 1 in the embodiment. This may be achieved by that the control unit CP first applies pulses more than the predetermined number to the step motor SL to rotate it in a direction and detects whether the signal representing the blocking state, transmitted from the sensor SZ, changes or not to the signal representing the transmitting state in response to the pulses. If detecting no change of signals, the control unit CP drives the step motor SL to rotate in a reverse direction, and confirms the change from the signal of the blocking state to another signal of the transmitting state to determine the rotating direction of the cam gear CK.

With the above structure, the control unit CP serving as a judging means can distinguish the press/release states between the platen P2 and the recording head HD and also the shifting state from the press to release states or from the release to press states. Concretely, when the detecting sensor SZ as a detecting means distinguishes the press/release states and the shifting state, the control unit CP can distinguish the press state and the release state based on the result detected by the sensor SZ.

A cut portion CK*d* is formed in the non-tooth portion CK*c*, in which a resilient piece CK*e* constructing a part of the tooth portion CK*g* is formed. When the gear C11 is in the non-tooth portion CK*c* of the cam gear CK in rotating the cam gear CK clockwise in FIG. 17, the resilient piece CK*e*, having resilience, is biased toward the eleventh gear C11 and not meshed with an outer peripheral tooth portion of the gear C11 by being flicked toward the center of the cam gear CK, thus allowing the cam gear CK not to rotate in a clockwise direction in FIG. 17.

Figure 18:
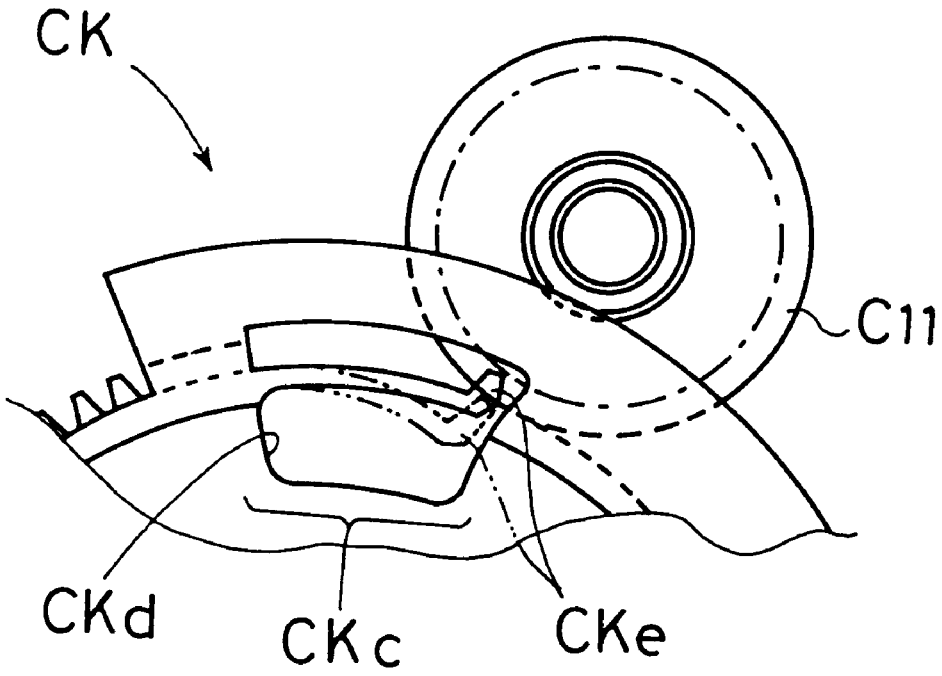
FIG. 18 is an enlarged front view of a part of the head driving cam gear of FIG. 17 and a gear.

To the contrary, the eleventh gear C11 can be meshed with the resilient piece CK*e* and the outer peripheral tooth CK*g* of the cam gear CK if the cam gear CK is rotated counterclockwise in FIG. 17. However, if the gear C11 in being at the non-tooth portion CK*c* attempts to rotate the cam gear CK in a counterclockwise after attempting to rotate the same in a clockwise direction, the gear C11 does not mesh with the tooth portion CK*g* of the cam gear CK. The carriage CA is therefore provided with a plate spring UB shown by a broken line in FIGS. 15 and 16, biasing the cam gear CK in a clockwise direction in FIGS. 15 and 16, whereby the gear C11 can mesh with the tooth portion CK*g* (as shown by an imaginary line in FIG. 18). It is noted that the detecting means for distinguishing which state the recording head HD is, a pressing state, a release state, or a moving state from the pressing to the release positions is not limited to the above example and may be other appropriate structures.

In FIG. 9, a sensor SY for detecting the presence of the recording head HD is provided on the rack LA at the back side of the swing lever YB, i.e., in an area where a recording operation in a line recording mode is made. This sensor SY serves as a detecting means for detecting an initial condition of the recording apparatus. The sensor SY detects the carriage CA when a protrusion RZ provided on the carriage CA comes into contact with a working member SY1 of the sensor SY during the movement of the carriage CA mounting thereon the recording head HD between the wide station WS and the tape station TS. The control unit CP can detect the existing position of the carriage CA accordingly.

Next, described is a mechanism for pressing/separating the recording head HD and others against/from the platen P1 for feeding the first recording medium D1.

Figure 6:
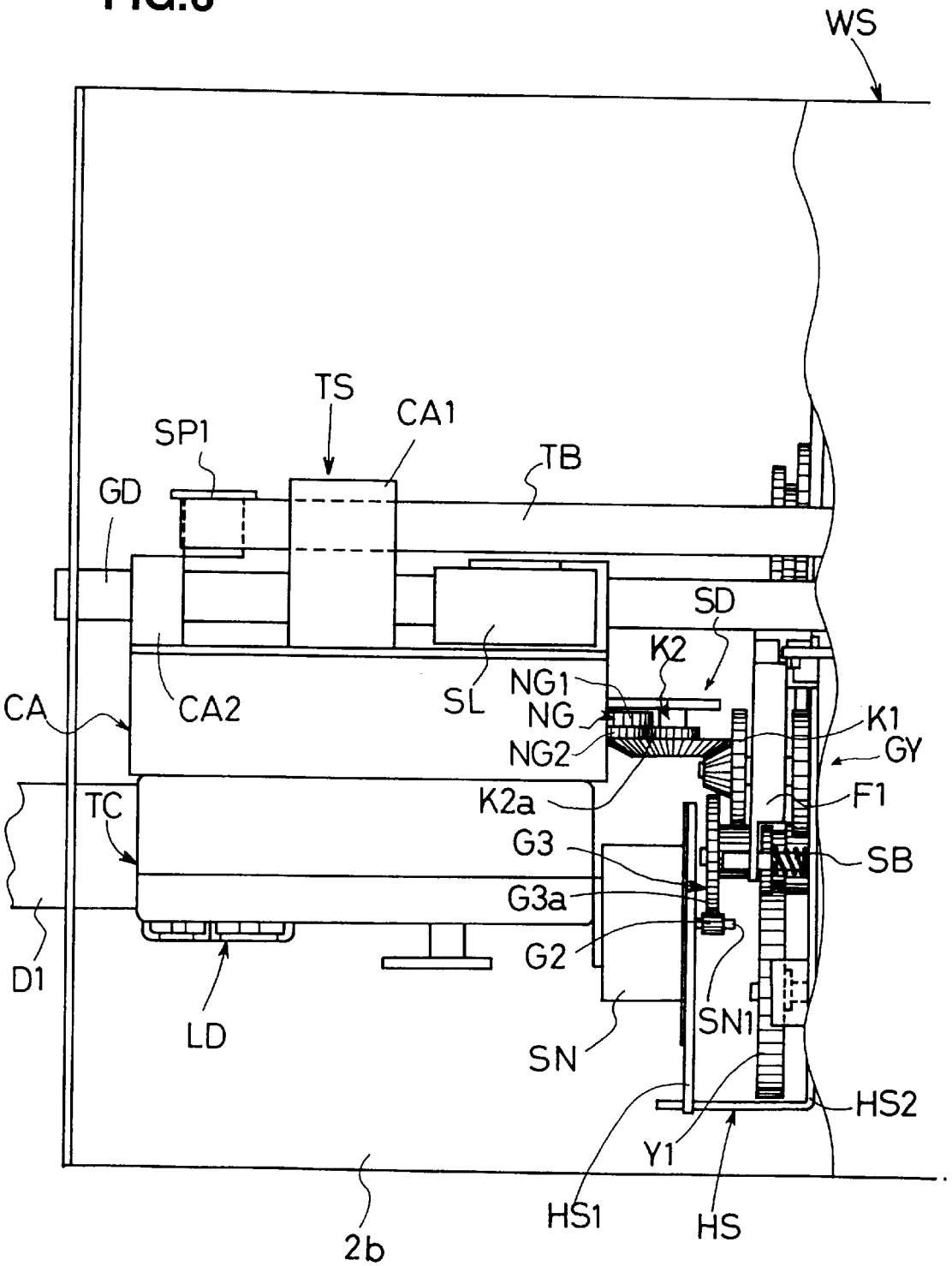
FIG. 6 is a partial enlarged plane view of the tape station shown in FIG. 3.

This mechanism comprises, as shown in FIG. 6, the driving motor SN for rotating a driving shaft SN1 in a regular or reverse direction and a rotation transmitting means SD which receives the rotation of the driving shaft SN1. In response to the rotation of the driving shaft SN1 in one direction, the rotation transmitting means SD works to make the roller holder LD supporting the platen P1 and the roller P3 press against the recording head HD and the roller TC6. In response to the rotation of the same in the reverse direction, to the contrary, the means SD works to make the roller holder LD to separate from the recording head HD and the roller TC6.

The step motor SN is fixedly mounted on the chassis HS at a side near the tape station TS, and is used for selectively performing a pressing/separating operation between the recording head HD and the platen P1 in the tape station TS and another operation to feed the second recording medium D2 in the wide station WS. The step motor SN is thus used as a driving power for two purposes in order to fully utilize the driving power of the step motor SN.

Figure 19:
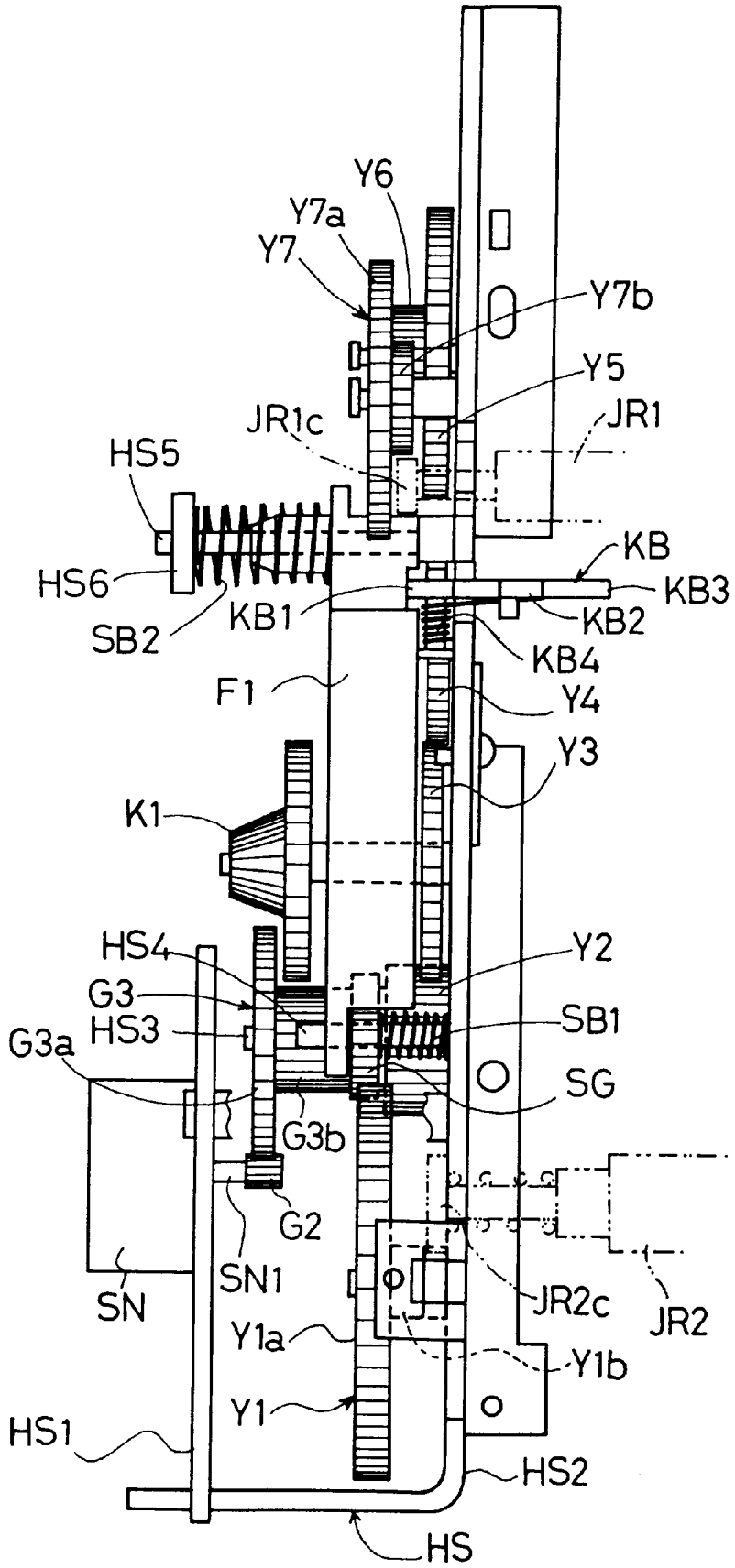
FIG. 19 is an enlarged plane view of main components for feeding the large-width recording medium and pressing/separating the recording head and a first platen.
Figure 20:
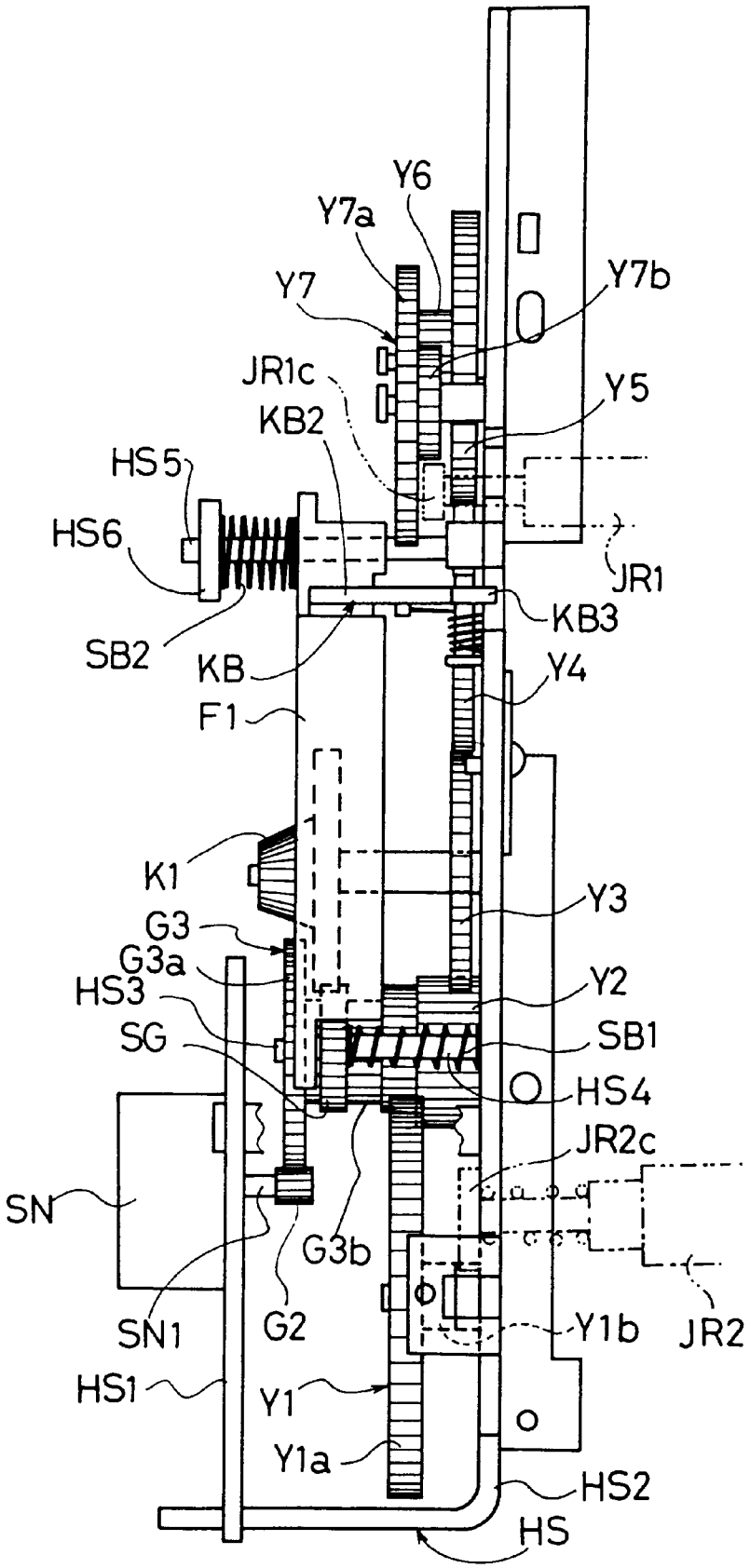
FIG. 20 is an enlarged plane view of the main components for feeding a large-width recording medium and pressing/separating the recording head and a first platen.

A gear train GY is provided between the short side chassis HS1 and the long side chassis HS2 of the chassis HS, which constructs a part of the rotation transmitting means SD, working for a paper feeding operation and for a pressing/separating operation. The gear train GY is constructed, as shown in FIGS. 6, 19 and 20, so as to selectively transmit the driving power for a pressing/separating operation between the recording head HD and the platen P1 in the tape station TS and the driving power for a paper feeding operation in the wide station WS. The driving shaft SN1 of the step motor SN is disposed extending through a hole not shown of the short side chassis HS1 toward the long side chassis HS2. At an end of the driving shaft SN1, mounted is a gear G2 which is rotatable integrally with the driving shaft SN1.

Figure 21:
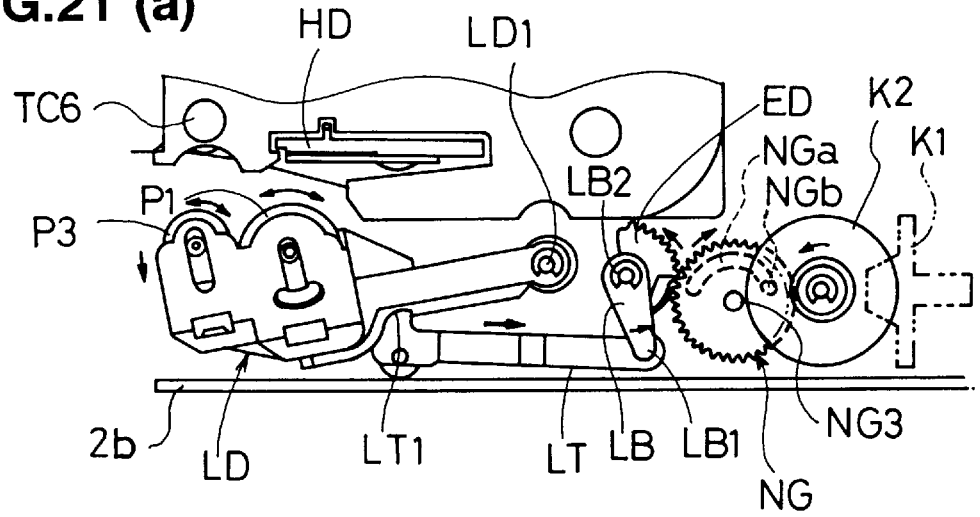
FIGS. 21(*a*) through (*c*) are explanatory views showing the relative position of the recording head to the first platen when the first platen is pressed to or separated from the recording head.
Figure 21:
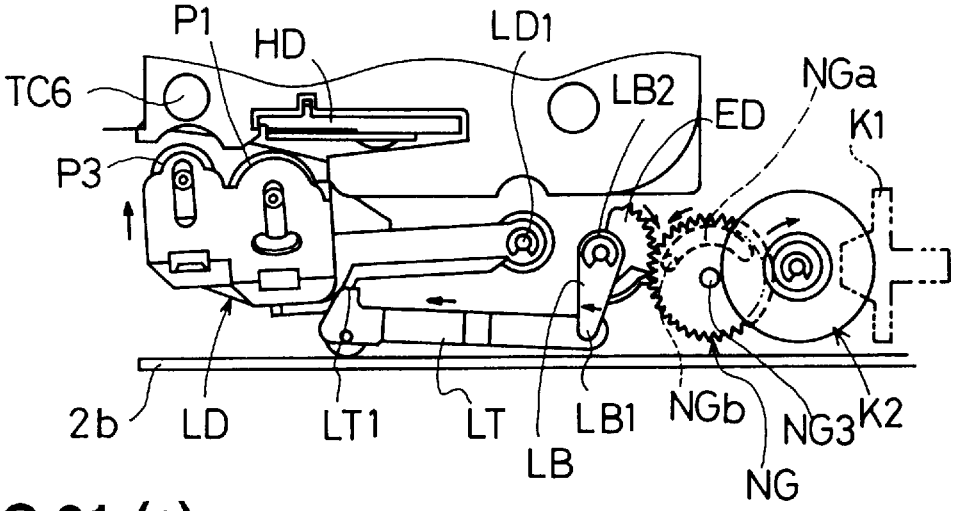
Figure 21:
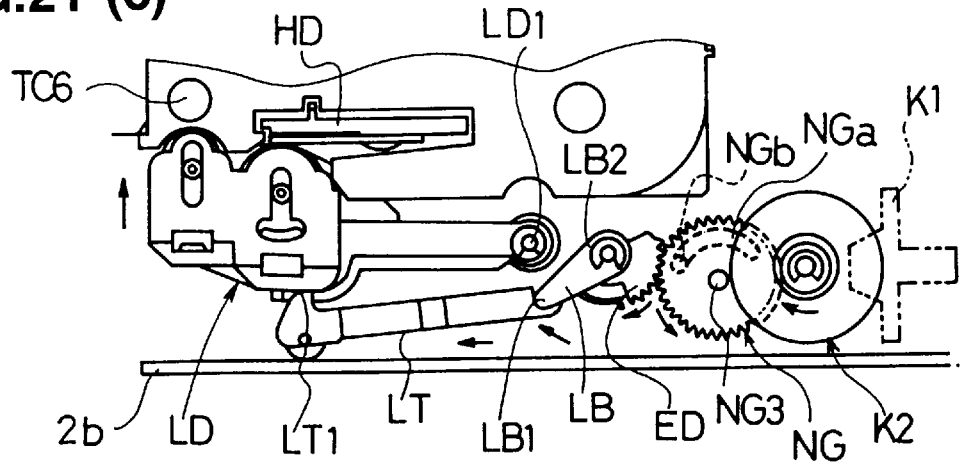

The gear G2 is meshed with a large diameter gear portion G3*a* of a gear G3, thereby transmitting the driving power for a pressing/separating operation between the recording head HD and the platen P1 to the rotation transmitting means SD including a small diameter gear portion G3*b* of the gear G3, a slidable gear SG, a first bevel gear K1, a second bevel gear K2, a double-gear NG serving as a member for delaying transmission, and a fan-shaped gear ED and the like (see FIGS. 6, 20, and 21). As a result, the roller release rod LT reciprocates in a lateral direction (see FIGS. 21(*a*) through 21(*c*)) in response to the regular or reverse rotation of the driving shaft SN1, moving the platen P1 and roller P3 both supported in the roller holder LD to press against or separate from the recording head HD and the roller TC6 respectively.

The structure for pressing/separating the platen P1 against/from the recording head HD is in further described in detail with reference with FIG. 21. The roller holder LD supports rotatably thereon the platen P1 and the roller P3 at the top end side and is supported on the carriage CA so as to be rotatable about a rotating shaft LD1. A cam member LT1 of the roller release rod LT, provided with a rotatable roller therein, is in contact with a lower side of the roller holder LD. With the movement of the roller release rod LT in a left direction (see FIG. 21(*b*)), the cam member LT1 pushes the roller holder LD up to press the platen P1 and the roller P3 against the recording head HD and the roller TC6 respectively (see FIG. 21(*c*)). When the roller release rod LT is moved in a right direction, to the contrary, the cam member LT1 not pushing the roller holder LD, the roller holder LD is moved down by its weight and is separated from the carriage CA (see FIG. 21(*a*)).

The roller release rod LT is connected at its bottom portion to a swing end LB1 of a swing plate LB and is constructed so as to be movable in a lateral direction according to the swing of the end LB1 in a lateral direction in FIG. 21. This swing plate LB is fixed at a bottom end LB2 with the fan-shaped gear ED. The swing movement of the end LB1 of the swing plate LB is thus caused when the end LB2 of the swing plate LB is rotated integrally with the fan-shaped gear ED which receives the driving power of the driving shaft SN1 rotating in a regular or reverse direction via the first bevel gear K1, the second bevel gear K2, and the double-gear NG. When the second bevel gear K2 is rotated counterclockwise (or clockwise), the double-gear NG is rotated clockwise (counterclockwise) and the fan-shaped gear ED counterclockwise (clockwise), moving the swing end LB1 of the swing plate LB in a right direction (a left direction), and thus the roller release rod LT in the same direction. It is noted that the structure of the rotation transmitting means SD is not limited to the above embodiment, a different structure from the above mentioned gear train may be used.

The rotation transmitting means SD comprises the double-gear NG serving as a member for delaying the transmission by a predetermined time, whereby the rotation of the driving shaft SN1 is not transmitted immediately in rotating in a reverse direction to perform the separating operation after the driving shaft SN1 is rotated in a regular direction to perform the pressing operation.

Figure 22:
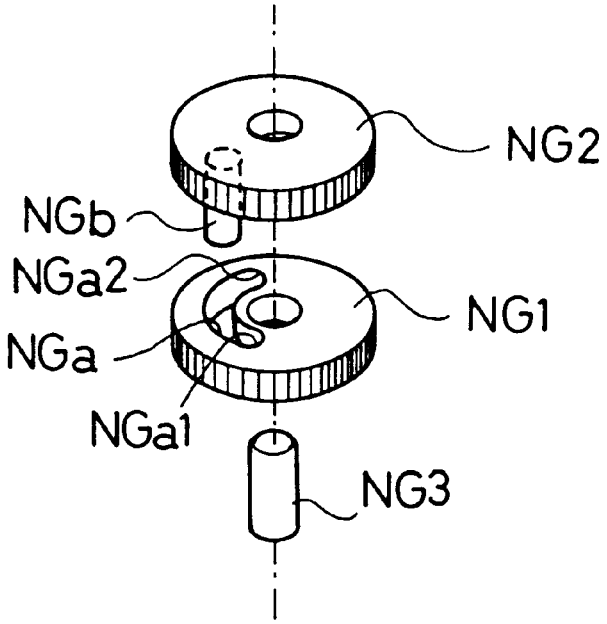
FIG. 22 is a perspective exploded view of a transmission delaying member in the embodiment.

This transmission delaying member is provided with two gears NG1 and NG2, as shown in FIG. 22, both gears being disposed coaxially with each other through a shaft NG3. The gear NG1 is provided therein with a long hole NG*a* and the gear NG2 is provided, on a plane facing the NG1, with a pin NG*b* which can be slidably inserted into the long hole NG*a*. While the pin NG*b* is made to slide between both ends NG*a*1 and NG*a*2 of the long hole NG*a*, the transmission delaying member does not transmit immediately the rotational driving power of the driving shaft SN1 even if the step motor SN drives the driving shaft SN1 to rotate in the reverse direction.

Specifically, the double-gear NG is disposed so that the gear NG2 is arranged at this side with respect to the drawing paper of FIG. 21 and the gear NG1 at the opposite side. These gears NG1 and NG2 are rotatable about the shaft NG3 being inserted into both through holes formed on the gears NG1 and NG2. The gear NG1 is meshed with only the fan-shaped gear ED as shown in FIG. 6, and the gear NG2 is meshed with only a base side gear K2*a* of the second bevel gear K2.

While the pin NG*b* inserted in the long hole NG*a* is slid between the both ends NG*a*1 and NG*a*2 by the rotation of the gear NG2 caused by the second bevel gear K2, the gear NG2 does not cause the rotation of the gear NG1 even if the driving shaft SN1 is driven to rotate in the reverse direction, thus not transmitting immediately the rotational driving power of the driving shaft SN1 to the fan-shaped gear ED. Right after the pin NG*b* comes into contact with any one of the ends NG*a*1 and NG*a*2 of the long hole NG*a*, the gear NG2 causes the gear NG1 to rotate, transmitting the driving power of the driving shaft SN1 to the fan-shaped gear ED.

As a result, the rotation transmitting means SD is stopped from immediately transmitting the driving power of the driving shaft SN1 for a predetermined time during the transmission delaying member works, namely, for a time during which the pin NG*b* is slid between the both ends NG*a*1 and NG*a*2 of the long hole NG*a*. This can remove or reduce detent torque of the step motor SN or the load exerted between the gears K1, K2, NG and ED. The transmission delaying member mentioned above is not always limited to the above embodiment, though. For example, the rotation transmitting means SD constructed of mechanical parts assembled with each other may be provided mechanically or electrically with a so-called play and a non-sensitive zone where the driving power of the driving shaft can not be immediately transmitted, both corresponding to the transmission delaying member. Other structures may be also used.

Moving in a left direction in FIG. 21(*c*), the cam member LT1 of the roller release rod LT is sandwiched between the roller holder LD and a bottom surface 2*b* of the main frame 2. This cam member LT1 in this state serves as a support means for supporting the platen P1 and the roller P3 as being in contact under pressure with the recording head HD and the roller TC6 respectively, without needing further the driving of the step motor SL. The recording head HD can thus print images on the first recording medium D1 supported between the platen P1 and the recording head HD. Accordingly, it is preferable to control the driving of the step motor SN to rotate the driving shaft SN1 in the reverse direction in FIG. 21(*c*) thereby to move the pin NG*b* from the end (NG*a*1) being in the recording head HD side to the other end (NG*a*2) being in the step motor SN side.

Figure 23:
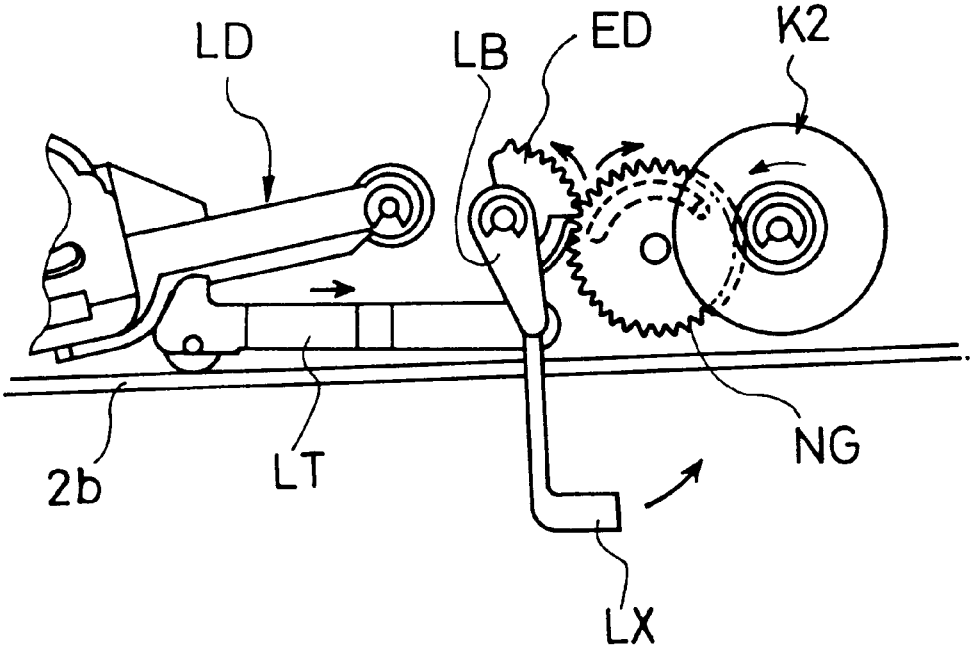
FIG. 23 is a front view of another embodiment of operation members for separating the recording head from the first platen.

In the embodiment, an operating unit (not shown) is disposed in the back of the main frame 2 so as to be operable in the outside of the main frame 2, thereby to release the pressing state of the platen P1 against the recording head HD by separating the platen P1 from the head HD. The operating unit, however, is not limited to the above structure. For example, an operational lever LX may be attached to the base end of the rod LT as shown in FIG. 23. When the operational lever LX is rotated in a direction shown by an arrow in FIG. 23 by taking an end portion of the lever LX by hand when the pin NG*b* is in the end (NG*a*2), the transmission of the driving power in the rotation transmitting means SD is released. The detent torque of the step motor SN or the load exerted on the gears K1, K2, and KG and the like being removed or reduced as mentioned above, the platen P1 can be separated from the recording head HD by a relatively small strength.

A structure of rotating the paper feeding roller members JR1 and JR2 is explained hereinafter. The slidable gear SG is slid in a lateral direction in FIGS. 19 and 20 by the switching lever KB in cooperation with springs SB1 and SB2, to be selectively meshed with a small diameter gear G3*b*. The large diameter gear G3*a* of the gear G3 in receiving the driving power of the step motor SN causes the rotation of the small diameter gear G3*b*, the slidable gear SG, and the first Y1 through seventh gears Y7 used for a paper feeding operation, disposed in order and parallel to the long side chassis HS2, making the roller members JR1 and JR2 rotate. By sliding the slidable gear SG in a lateral direction in FIGS. 19 and 20, the driving power of the step motor SN can be utilized for feeding paper in the recording operation in the wide station WS and for pressing or separating the platen P1 against or from the recording head HD in the tape station TS, to fully utilize the driving power of the step motor SN serving as a driving power source.

A rotating axis HS3 is provided on the long side chassis HS2 toward the short side chassis HS1. On this rotating axis HS3, two gears, namely, the gear G3 and the second gear Y2 are mounted side by side so as to be rotatable about the rotating axis HS3. The gear G3 arranged in a side near the short side chassis HS1 is constructed of the large diameter gear G3*a* and the small diameter gear G3*b*, both being integrally formed. On the other hand, the second gear Y2 arranged in a side near the long side chassis HS2 is made in the form of a flat plate. The slidable gear SG arranged in the side of the gear G3 is made slidable on a support HS4 fixed on the long side chassis HS2, extending toward the short side chassis HS1, as meshed with the small diameter gear G3 of the gear G3.

On the support shaft HS4, the spring SB1, the slidable gear SG, and a slidable member F1 are attached in that order from the long side chassis HS2 side, in which the spring SB1 biases the slidable gear SG and the slidable member F1 toward the short side chassis HS1 side. A support shaft HS5 is fixed on the long side chassis HS2 at its backside (in an upper part in FIG. 19) so as to extend from the wide station WS side to the tape station TS side. The support shaft HS5 is provided at a tip end thereof with a stopper HS6. The slidable member F1 and the spring SB2 are mounted on the support shaft HS5, in which the spring SB2 biases the slidable member F1 toward the wide station WS side.

With the cooperative action of the springs SB1 and SB2 and the switching lever KB, the slidable member F1 is made to move the slidable gear SG close to the long side chassis HS or the short side chassis HS1, then to mesh the same with any one of the first bevel gear K1 and the first gear Y1.

Figure 24:
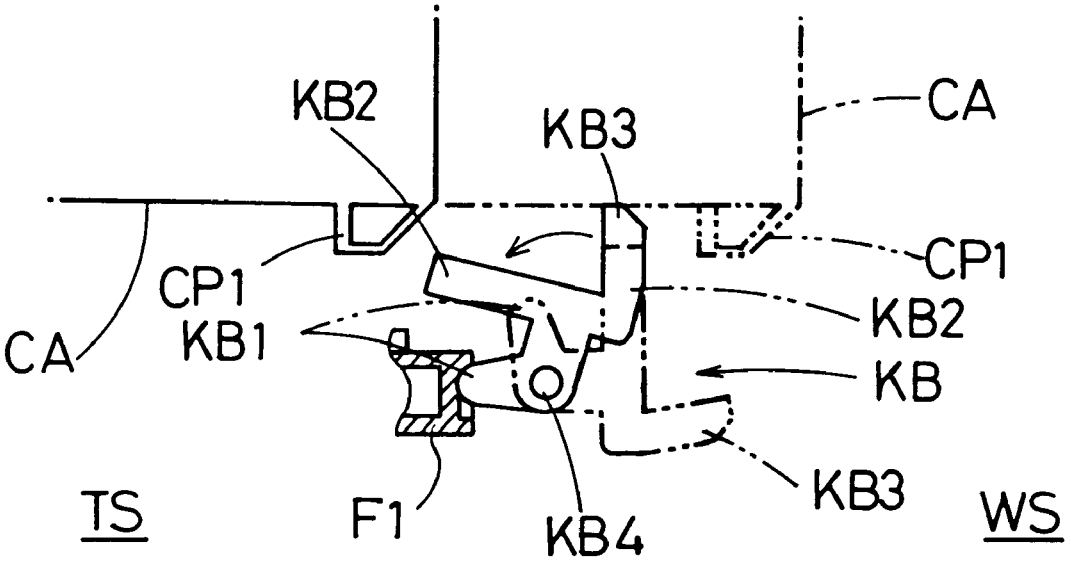
FIG. 24 is an explanatory view of showing the relation between the movement of the carriage and a switch lever in the first embodiment according to the present invention.

The switching lever KB serving to mesh the slidable gear SG with any one of the first bevel gear K1 and the first gear Y1 is constructed of a first, a second, and a third arm portions KB1, KB2, and KB3 as shown in FIG. 24. This switching lever KB is mounted on an axis KB4 fixed to the long side chassis HS2, so as to be rotatable about the axis KB4. By coming into contact with the slidable member F1 or not, the switching lever KB can move the slidable gear SG toward the long side chassis HS2 side (i.e., the wide station WS side) or toward the short side chassis HS1 (i.e., the tape station TS side).

While the carriage CA is positioned in the tape station TS, the switching lever KB is in a state where the first and second arm portions KB1 and KB2 are rotated about the axis KB4 toward the tape station TS and the third arm portion KB3 stands up, so that an tip end of the first arm portion KB1 presses the slidable member F1 as shown by a solid line in FIG. 24, thereby moving the slidable member F1 toward the tape station TS side (see FIG. 20). On the other hand, while the carriage CA is in the wide station WS, the switching lever KB is in a state where the first and second arm portions KB1 and KB2 are rotated to stand up and the third arm portion KB3 is accordingly turned toward the wide station WS side as shown by an imaginary line in FIG. 24, so that the tip end of the first arm portion KB1 does not press the slidable member F1. Accordingly the slidable member F1 is moved to the long side chassis HS2 side (i.e., the wide station WS side) and comes into contact with a side of the first arm portion KB1 (see FIG. 19).

In the movement of the carriage CA from the tape station TS to the wide station WS (from the solid line to the imaginary line in FIG. 24), a protrusive portion CP1 serving as a contact member formed in the carriage CA pushes the side of the third arm portion KB3 to rotate the switching lever KB at an angle of almost 90° about the axis KB4, releasing the first arm portion KB1 from the slidable member F1. To the contrary, in the movement of the carriage CA from the wide station WS to the tape station TS (from the imaginary line to the solid line in FIG. 24), the protrusive portion CP1 pushes the side of the second arm portion KB2 to rotate the switching lever KB toward the tape station TS at an angle of almost 90° about the axis KB4, making the tip end of the first arm portion KB1 engage with the slidable member F1.

In this way, when the switching lever KB in cooperation with the spring KB1 moves the slidable member F1 toward the short side chassis HS1, i.e., the tape station TS side (see FIG. 20), the slidable gear SG is meshed with the small diameter gear G3*b* of the gear G3. As a result, the slidable gear SG is also meshed with the first bevel gear K1 and thus transmits the driving power utilized for pressing or separating the roller holder HD against or from the recording head HD in the recording operation in the tape station TS, as mentioned above.

When the switching lever KB in cooperation with the second spring SG2 moves the slidable member F1 toward the long side chassis HS2, i.e., the wide station WS side (see FIG. 19), the slidable gear SG is meshed with the first gear Y1 disposed at the side of the second gear Y2. As a result, the slidable gear SG transmits the driving power utilized for feeding paper in the recording operation in the wide station WS to the second Y2 through seventh gears Y7 forming the gear train.

The first gear Y1 comprises a large diameter gear Y1*a* to be meshed with the slidable gear SG and a small diameter gear Y1*b* arranged at the side of the larger diameter gear Y1*a*. The small diameter gear Y1*b* is meshed with a gear JR2*c* attached to the end of a shaft JR2*b* of the roller member JR2, thereby to rotate the shaft JR2*b* to feed the top end of the second recording medium D2 forward and backward. The large diameter gear Y1*a* of the first gear Y1 is meshed with the second gear Y2. This second gear Y2 is meshed with the third gear Y3 arranged at the side of the second gear Y2 (in an upper side thereof in FIGS. 19 and 20), and the third gear Y3 is meshed with the fourth gear Y4 arranged at the side of the gear Y3 (in an upper side thereof in FIGS. 19 and 20).

The fourth gear Y4 is meshed with the fifth gear Y5 arranged at the side of the fourth gear Y4 (in an upper side thereof in FIGS. 19 and 20) and the fifth gear Y5 is meshed with the sixth gear Y6 arranged at the side of the fifth gear Y5 (in a left side thereof in FIGS. 19 and 20). This sixth gear Y6 is meshed with the seventh gear Y7 arranged at the side of the sixth gear Y6 (at this side in FIGS. 19 and 20). This seventh gear Y7 comprises a large diameter gear Y7*a* meshing with the sixth gear Y6 and a small diameter gear Y7*b* arranged at the long side chassis HS2 side of the large diameter gear Y7*a*. The small diameter gear Y7*b* is meshed with a gear JR1*c* attached to the end of a shaft JR1*b* of the roller member JR1, thereby to rotate the shaft JR1*b* to feed the top end of the second recording medium D2 forward and backward.

It is noted that a gear ST4 is provided at the side of the larger diameter gear Y7*a* (in an upper side thereof in FIG. 3) to connect the large diameter gear Y7*a* with a gear ST3 which is rotatable integrally with the supporting member ST1. The supporting member ST1, in receiving the rotational driving power of the step motor SN through the above gears, rotates to wind back the top end of the second recording medium D2 being in a rolled state or to draw the same.

Figure 14:
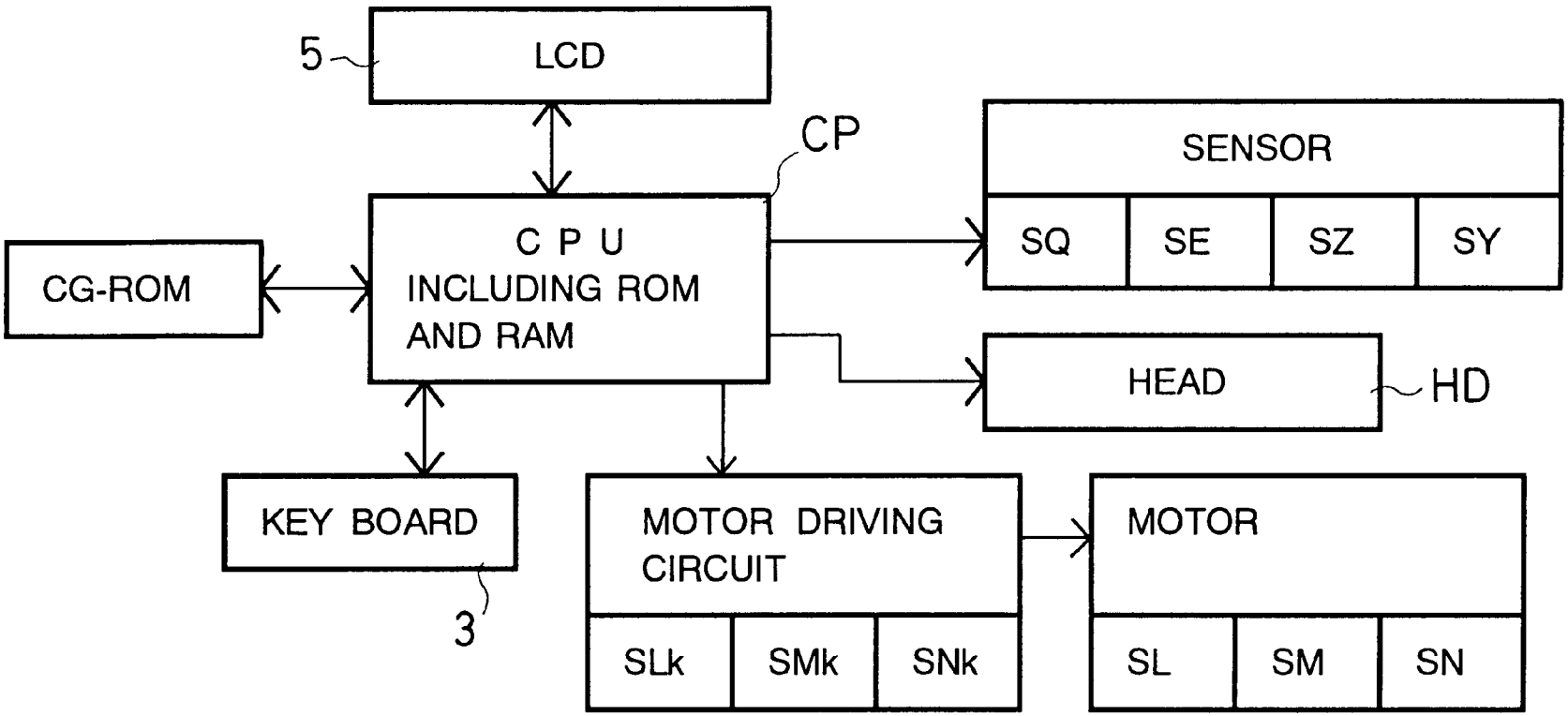
FIG. 14 is a block diagram showing a control system of the tape printing apparatus in the embodiment.

Next, the control system of the tape printing apparatus 1 in the embodiment is explained with reference to FIG. 14. The control unit CP of the tape printing apparatus 1 comprises a central processing unit (CPU) as a core, the CPU including a read only memory (ROM) and a random access memory (RAM). The ROM stores a control program for controlling the driving of the motors SL, SM, and SN, a display program for displaying on the display 5 the images such as characters input through each key of the keyboard 3, and other programs needed for operating the tape printing apparatus 1. CG-ROM connected to the CPU is a character generator for producing image data in displaying or printing the character images and the like. The RAM has various data storing area, e.g., display buffer, print buffer, to temporarily the data in each corresponding area.

Motor driving circuits SLk, SMk, and SNk are the circuits for driving the step motors SL, SM, and SN respectively. The sensors SQ, SY, SE, and SZ detect, as mentioned above, whether the cassette TC or RC is set or not, whether the carriage CA exists or not, and the kind, the width of the first or second recording medium D1 or D2 and the like, respectively, and then transmit signals representing the detected result to the CPU. Provided with a plurality of heating elements arranged in a row, the recording head HD can print images on the first or second recording medium D1 or D2 through the ink ribbon IR by the heating elements selectively driven by the CPU.

Next, the control operation of the control unit CP to initialize the tape printing apparatus will be described hereinafter. Here, initializing the recording apparatus intends to put the apparatus into a stand-by mode for a recording operation. This stand-by mode may be a condition where the apparatus can immediately start a recording operation and another condition where the apparatus can start a recording operation after other steps.

The detecting sensor SY serving as a detection device is disposed on the carrying way of the carriage CA. The detecting sensor SY is used for putting the tape printing device 1 in the initial condition. The detecting sensor SQ for distinguishing between the tape cassette TC (the first cassette) and the ribbon cassette RC (the second cassette) and the transmitting type sensor SZ are also utilized for initialization of the tape printing device 1.

Figure 25A:
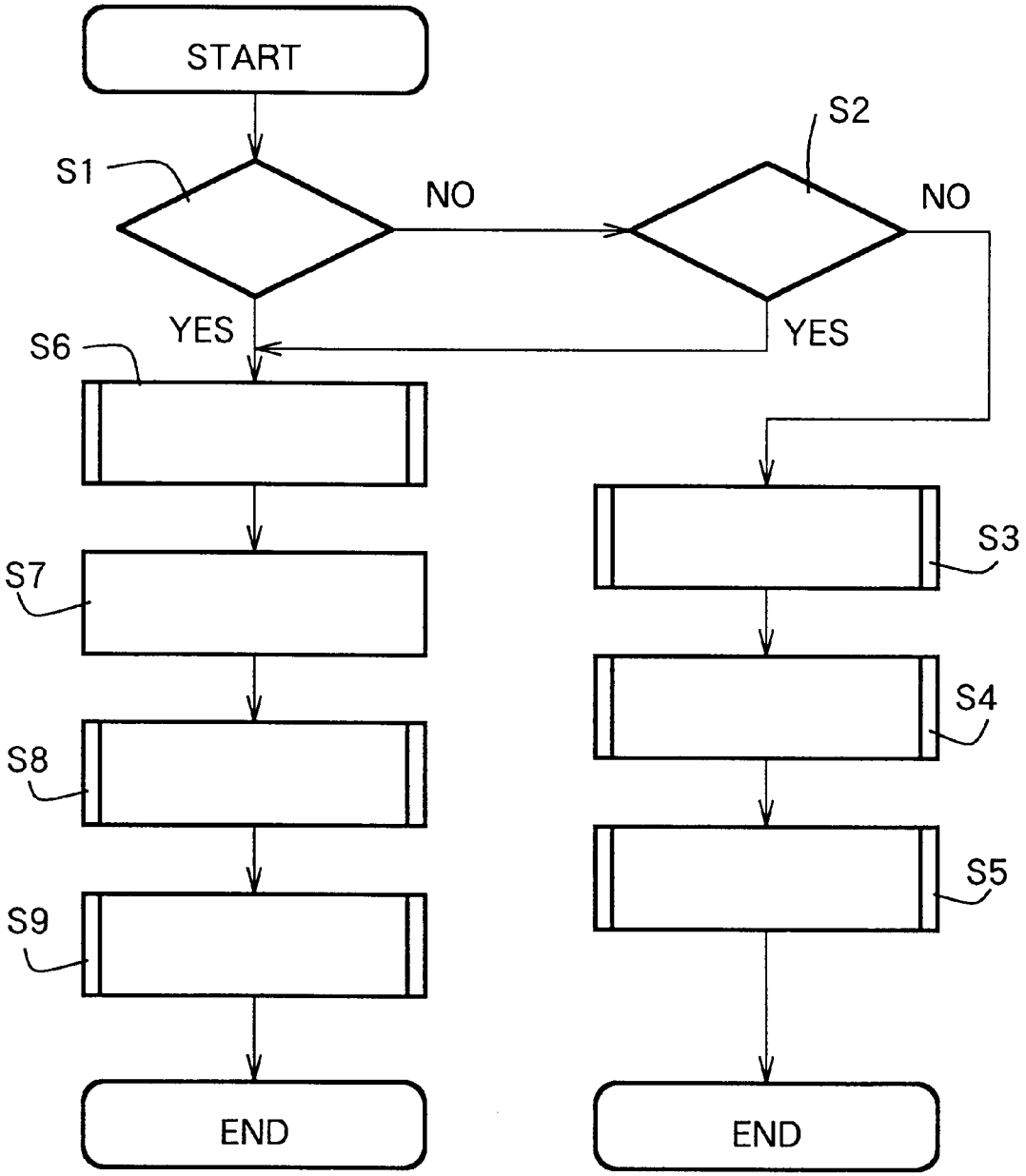
FIGS. 25(A) and (B) are a flow chart and a table showing the control operation of a control unit in the first embodiment.

As shown in FIG. 25, the control unit CP judges as to whether the tape cassette TC is set on the carriage CA or not, namely, whether the signal of the detecting result of the detecting sensor SQ represents a tape cassette TC (in S1). When it is detected to be "NO" in Si or neither the cassette TC nor the cassette RC is set on the carriage CA, it is judged whether the sensor SY is ON or not (S2). When it is detected to be "NO" in S2, that is, when the recording head HD is in the wide station WS (the serial recording mode), the control unit CP controls to detect the starting point for press/release operations of the head HD (S3). In case of the control for detecting the starting point for press/release operations of the head HD, as mentioned before, the non-tooth portion CK*c* of the head driving cam gear CK acts to make the recording head HD be separated from the platen P2, which can prevent the head HD from sliding as touching the surface of the platen P2.

The control unit CP then controls to detect the home position of the carriage CA in the tape station TS (S4), namely, to move the carriage CA so that the sensor SY be ON. This is to enable to set any of the cassettes TC and RC on the carriage CA inside of the cover case 7 or to change the cassette TC on the carriage CA to the cassette RC, and vice versa. Succeedingly, the control unit CP controls to detect the home position of the roller holder LD (S5) so as to separate the roller holder LD from the recording head HD. In this way, the control unit CP drives the carriage CA to move in S2 so that the sensor SY becomes ON in S4 even if it is detected to be "NO" in S2, so that the carriage CA exists in the tape station TS. As a result thereof, the tape printing apparatus 1 is put in the initial condition, i.e., in a stand-by mode for starting recording, the line recording operation can be performed in the tape station TS as well as the serial recording operation in the wide station WS as mentioned above.

On the other hand, when it is detected to be "YES" in S1, in other words, when the tape cassette TC is set on the carriage CA or when it is detected to be "YES" in S2 as the sensor SY is ON, the control unit CP controls to detect the home position of the roller holder LD (S6) to separate the roller holder LD from the recording head HD. This is because it is hard to move the carriage CA toward the wide station WS if the driving roller P1 of the roller holder LD is in contact with the recording head HD.

The control unit CP moves the carriage CA to the wide station WS (S7) and controls to detect the starting point of the head HD for press/release operations, making the head HD be separated from the platen P2. Thereafter, the control unit CP controls to detect the home position of the carriage CA in the tape station TS (S9), namely, to move the carriage CA so that the sensor SY be ON. The control unit CP controls, in this way, so as to judge to be "YES" again in S2 even when it was detected to be "NO" in S1, in order to correctly make the carriage CA be positioned in the tape station TS. Accordingly, the tape printing apparatus 1 is initialized, in other words, it is put in a stand-by mode for starting recording.

The control unit CP in the embodiment, as mentioned above, gives priority to the detection result of the detecting sensor SQ and the discrimination result of the sensor SY and thus can precisely conduct the steps for initializing in the serial recording mode or the line recording mode, which causes no structural contradiction in the tape printing apparatus 1 even if the step for initializing starts in any mode.

Figure 27A:
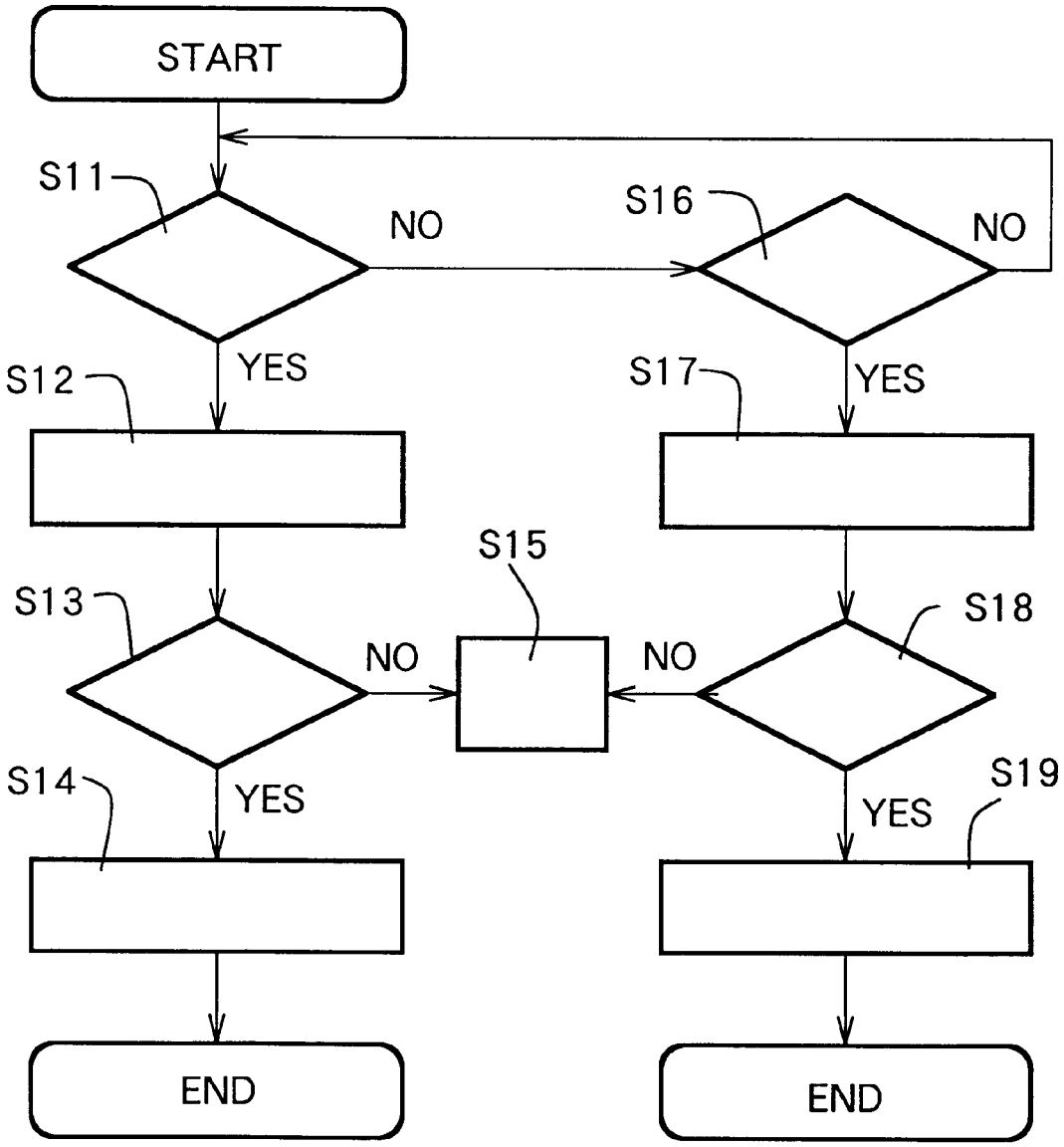
FIGS. 27(A) and (B) are a flow chart and a table showing another control operation of the control unit in the first embodiment.

Next, referring to FIG. 27, explanation is made on the control operation of the control unit CP which detects if a line recording mode command or a serial recording mode command is in agreement with a detected result of the detecting sensor SQ. The detecting sensor SQ serving as a detection device distinguishes between the tape cassette TC which is a first cassette and the ribbon cassette RC which is a second cassette. The control unit CP inputs signals representing the detected result and signals input through keys provided on the key board 3 by an user. The control unit CP detects, as shown in FIG. 27, if the signal represents or not the recording command for the tape station TS (S11). In other words, the control unit CP detects if the user depresses a recording key for tape station TS. The control unit CP thus constructs a judging means.

When a recording key for tape station TS, i.e., for a line recording mode is depressed, the control unit CP determines "YES" in S11 and the program is advanced to S12. Based on the output signal of the detecting sensor SQ, the control unit CP detects if one of the cassettes RC and TC is set on the carriage CA (S12) and then if the output signal of the sensor SQ is in agreement with the signal of the recording key for the line recording mode (S13). When receives the signal representing that the cassette TC is set on the carriage CA from the sensor SQ, the control unit CP selects "YES" in S13 to perform recording in the tape station TS, i.e., in the line recording mode (S14). In S3, when receives the signal representing that the cassette RC is set on the carriage CA from the sensor SQ, the control unit CP selects "NO" to display an error-indication message on the display 5.

On the other hand, when a negative decision is made in S11, the control unit CP detects if a recording key for wide station WS, i.e., for a serial recording mode is depressed (S16). If the recording key is not depressed, the control unit CP judges to be "NO" in S16 and the program is returned to S11. When the recording key is depressed, alternatively, the control unit judges to be "YES" in S16.

Succeedingly, the control unit CP detects if one of the cassettes RC and TC is set on the carriage CA based on the output signal transmitted from the sensor SQ (S17) and then detects if the output signal from the sensor SQ is in agreement with the recording key for the serial recording mode (S18). When receives the signal representing that the cassette RC is set on the carriage CA from the sensor SQ, the control unit CP judges to be "YES" in S18 and performs recording in the wide station WS, i.e., in the serial recording mode (S19). When receives the signal representing that the cassette TC is set on the carriage CA from the sensor SQ, to the contrary, the control unit CP judges to be "NO" in S18 to display an error-indication message on the display 5 (S15). In this way, displaying of the error-indication message on the display 5 or, for example, sounding of the alarm informs an user of an error of the cassette TC or RC set on the carriage CA, so that the user can change the cassette TC or RC to a correct cassette.

Since the control unit CP detects if the detection result of the sensor SQ is in agreement with the line recording mode command and the serial recording mode command in accordance with the recording key on the keyboard 3, incorrect use of the cassette, namely, use of the cassette TC in the serial recording mode or the cassette RC in the line recording mode is prevented. In the above embodiment, the sensor SQ serving as a detection device distinguishes the cassettes RC and TC, but it is not limited thereto. For example, the sensor SQ may detects one of the small-width recording medium D1 or the ink ribbon IR in the tape cassette TC used in the line recording mode, or, one of the large-width recording medium D2 used in the serial recording mode or the ink ribbon IR in the ribbon cassette RC. The line recording mode command and the serial recording mode command may be input by other ways than the key operation of the keyboard 3.

As mentioned above in detail, the tape printing apparatus 1 in the embodiment is provided with the recording head HD which is to be pressed against or separated from the first recording medium D1 and the platen P1 acting as a driving roller for feeding the first recording medium D1 with respect to the recording head HD. This tape printing apparatus 1 performs recording in a line recording mode in which the recording head HD, as fixed, is pressed against the first recording medium D1 to record images on the first recording medium D1 while the platen P1 feeds the first recording medium D1. The tape printing apparatus 1 is also provided with the head moving means CH for moving the carriage CA reciprocatingly in the main scanning direction of the second recording medium D2, the carriage CA mounting thereon the recording head HD which is to be pressed against or separated from the second recording medium D2, and a platen P2 for supporting the second recording medium D2 in feeding in the sub-scanning direction (the second direction). This tape printing apparatus 1 performs recording in a serial recording mode wherein the recording head HD records images on the second recording medium D2 by being pressed against the platen P2 and moving in the main scanning direction. Accordingly, the tape printing apparatus 1 can be made at extreme low cost without needing a rotating mechanism used in the prior art. On the way of moving the carriage CA, there is provided the detecting sensor SY for putting the tape printing apparatus 1 in the initial condition and the control unit CP for controlling the movement of the carriage CA so that the detecting sensor SY may detect the carriage CA moved in the serial recording mode with the recording head HD separated from the platen P2 to make the detecting sensor SY detect and in the line recording mode with the recording head HD separated from the platen P1.

In the serial recording mode, the control unit CP drives to move the carriage CA with the recording head HD separated from the platen P2 and drives the detecting sensor SY to detect the carriage CA to put the carriage CA in the initial condition. In the line recording mode, the control unit CP drives to move the carriage CA with the recording head HD separated from the platen P1 and the detection sensor SY detects the carriage CA, so that the initializing operation can precisely be made by predetermined steps at the time of applying electric power to the apparatus or exchanging the cassettes.

Specifically, the recording apparatus in performing recording in the serial recording mode is needed to be initialized by feeding the carriage CA after separating the recording head HD from the platen P2 to drive the detection sensor SY to detect the carriage CA. If not so, in the worst case, the recording head HD may slid on the surface of the platen P2 as being in contact with it, and the carriage CA may be moved with the ink ribbon IR and the like dragged from the second cassette RC, resulting in impossible use of the ink ribbon IR. Such the situation must be prevented from occurring. To initialize the recording apparatus in performing recording in the line recording mode, similarly, it is needed to move the carriage CA after separating the recording head HD from the platen P1 to drive the detection sensor SY to detect the carriage CA. If not so, the carriage CA may be moved with the recording head HD as being contact under pressure against the platen P1. The occurrence of this situation must be prevented.

As mentioned above, furthermore, the tape printing apparatus 1 in the embodiment comprises the recording head HD on which recording elements are arranged in a row at least in one direction, the step motor SN and gear train GY for feeding the top end of the recording medium D2 with a long length in a direction of the row of the recording elements, and the cutting unit KC for cutting the recording medium D2, disposed downstream of the recording head HD in the feeding direction of the recording medium D2. The tape printing apparatus 1 performs recording by feeding the top end of the recording medium D2 by an amount each corresponding to the length L1 of the recording element row and by making the recording head HD scan the recording medium D2 supported in a stopped state. The control unit CP controls to reduce the feeding amount (L3) of the recording medium D2 just before the cutting operation of the cutting unit KC less than the length (L1) of the recording element row, and to feed the recording medium D2 by the remaining amount (L4) after the cutting operation, then to drive the recording head HD to record. Accordingly, it is possible to prevent the generation of white lines between the portions recorded before and after the cutting operation and large overlap of the recorded portions, so that those recorded portions can smoothly be connected to produce clear images on the recording medium D2.

As described above, the tape printing apparatus 1 in the embodiment is provided with a recording head HD and a head moving means CH for moving reciprocatingly the recording head HD in the main scanning direction, to perform recording using the ink ribbon IR while fixing the recording head HD with respect to the small-width recording medium D1 in the line recording mode and by moving the recording head HD reciprocatingly in the main scanning direction through the ink ribbon on the large-width recording medium D2 in the serial recording mode. The apparatus is also provided with the control unit CP for detecting one of the small-width recording medium D1 or the ink ribbon IR in the tape cassette TC used in the line recording mode, or, one of the large-width recording medium D2 used in the serial recording mode or the ink ribbon IR in the ribbon cassette RC, and detects if the detected result is in agreement with the line recording mode command and the serial recording mode command. Accordingly, it is possible to provide the tape printing apparatus 1 which can be easily operated in the line recording mode and the serial recording mode at a reduced manufacturing cost.

Furthermore, as mentioned above, the tape printing apparatus 1 in the embodiment is provided with the recording head HD on which a plurality of heating elements are disposed in a row and a feeding mechanism for feeding the first recording medium D1 and the ink ribbon IR. This tape printing apparatus 1 performs recording on the first recording medium D1 through the ink ribbon IR by using the recording head fixedly supported while the medium feeding means feeds the first recording medium D1 and the ink ribbon IR in an intersecting direction (the first direction) with respect to the arrangement direction of the heating elements. The tape printing apparatus 1 is also provided with the head moving means CH for moving reciprocatingly the recording head HD and the ink ribbon IR in the main scanning direction intersecting the heating element arrangement direction in the area where the large-width recording medium D2 differently from the first recording medium D1, and a feeding means GY for feeding the second recording medium D2 in the heating element arrangement direction. The tape printing apparatus 1 performs recording in a serial recording mode in which the recording head HD moving in the main scanning direction records images on the second recording medium D2 supported in a stopped state through the ink ribbon IR and, after recording, the second recording medium D2 is fed by a predetermined amount in the heating element arrangement direction, and then the recording head HD moves again in the main scanning direction to record images on the second recording medium D2 again. Accordingly, the recording head HD can record on the first recording medium D1 through the ink ribbon IR in a line recording mode wherein the first recording medium D1 and the ink ribbon IR are fed in a direction orthogonal to the arrangement direction of the heating elements as the recording head HD is fixedly supported with respect to the first recording medium D1. The recording head HD can record on the second recording medium D2, on the other hand, through the ink ribbon IR in the serial recording mode wherein the recording head HD is moved reciprocatingly in the main scanning direction orthogonal to the heating element arrangement direction, without needing the rotation of the recording head HD.

The apparatus 1 is further provided with the first platen P1 for supporting the first recording medium D1 so as to be opposite to the recording head HD in the line recording mode and the second platen P2 for supporting the second recording medium D2 so as to be opposite to the recording head HD in the serial recording mode. It is therefore possible to use one of the first and second platens P1 and P2 according to the recording modes.

According to the tape printing apparatus 1 in the embodiment described above, provided are the recording head HD capable of recording on the first recording medium D1 and the platen P1 acting as a driving roller for feeding the first recording medium D1 with respect to the recording head HD. While the platen P1 feeds the first recording medium D1, the recording head HD in a fixed state records on the first recording medium D1 in the line recording mode. The tape printing apparatus 1 is also provided with the head moving means CH for moving the carriage CA reciprocatingly in the main scanning direction of the second recording medium D2, the carriage CA mounting thereon the recording head HD, and the rollers JR1 and JR2 serving as a feeding device for feeding the second recording medium D2 in a sub-scanning direction, where the recording head HD records on the second recording medium D2 supported as stopped while the recording head HD is made to scan in the main scanning direction as being pressed against the second recording medium D2. Upon completion of the recording operation, the second recording medium D2 is separated from the recording head HD and fed in the sub-scanning direction by a predetermined amount, and then the recording head HD moving in the main scanning direction records again in the serial recording mode. At this time, since the step motor SL for feeding the first recording medium D1 is used for pressing or separating the recording head HD against or from the second recording medium D2, the driving power of the driving power source can be efficiently used.

According to the tape printing apparatus 1 in the embodiment, it is provided with the recording head HD capable of recording on the first recording medium D1 as being in contact under pressure against the medium D1, and the platen P1 which can be pressed against and separated from the recording head HD, acting as a driving roller for feeding the first recording medium D1 while it is pressed against the recording head HD. While the platen P1 feeds the first recording medium D1, the recording head HD in a fixed state records on the first recording medium D1 in the line recording mode. The tape printing apparatus 1 is also provided with the carriage moving means CH for moving the carriage CA mounting thereon the recording head HD in the main scanning direction of the second recording medium D2 in the area where the second recording medium D2, different from the first recording medium D1, is disposed, and the platen P2 for supporting the second recording medium D2 which is to be fed in the sub-scanning direction. The recording head HD moving in the main scanning direction records on the second recording medium D2 supported as stopped. After the completion of the recording operation, when the second recording medium D2 is fed by a predetermined amount in the sub-scanning direction, the recording head HD records again while it is moving in the main scanning direction in the serial recording mode. In this case, since the step motor SN acting as a driving power source for feeding the second recording medium D2 is used to press/separate the recording head against/from the first recording medium D1, the tape printing apparatus 1 can be manufactured at low cost.

The present invention may be embodied in other specific forms without departing from the spirit or essential characteristics thereof. For instance, in the embodiment, the first cassette TC accommodating the recording medium D1 is used in the line recording mode and the second cassette RC accommodating only the ink ribbon IR is used in the serial recording mode, but the present invention is not limited thereto. A cassette TC accommodating only the recording medium D1 may be used, for example. The ink ribbon IR in the second cassette RC is not limited to the ink ribbon on which plural colors of ink are applied, may be a single colored-ink ribbon. Furthermore, motors besides the step motor may be used.

Though it is preferable that the step motor SL for feeding the first recording medium D1 is used for a press/release operation between the recording head HD and the second recording medium D2 in the serial recording mode and the step motor SN for feeding the second recording medium D2 is used for a pressing/separating operation between the recording head HD and the first recording medium D1 in the line recording mode, it is not limited to such a condition.

Preferably, the first platen P1 is formed in the shape of a cylinder and the second platen P2 is formed to have a flat surface for supporting the second recording medium D2; however, no limitation is put thereon.

The cassette HS0 (see FIG. 4) supporting the second recording medium D2 as rolled may be provided with a feeding roller at the paper feeding port side. The platen and the driving roller are formed of separate members in the above embodiment and may be formed of an integral member. Furthermore, any one or both of the platen and the driving roller may be provided.

The recording apparatus of the invention is not limited to the tape printing apparatus and may be applied to, besides a general thermal printer and the like, a stamper using thermosensitive porous paper and porous resin plate and the like as a recording medium, which is to be used as print manuscripts of stamps.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A recording apparatus, comprising:

a recording head mounted on a carriage, on which a plurality of recording elements are arranged in a row;

first feeding means for feeding a first recording medium in a first direction with respect to the recording head;

line recording mode setting means for setting a line recording mode wherein the recording head in a fixed position performs recording on the first medium while said first feeding means feeds the first recording medium in the first direction;

a first station wherein the line recording mode is conducted;

carriage moving means for moving the carriage reciprocatingly in the first direction;

second feeding means for feeding a second recording medium in a second direction which is different from the first direction;

serial recording mode setting means for setting a serial recording mode wherein the recording head performs recording on the second recording medium which is in a stopped state while said carriage moving means moves the carriage mounting thereon the recording head in the first direction with respect to the second recording medium;

a second station wherein the serial recording mode is conducted;

a first driving power source for driving the first feeding means, the first driving power source being used for pressing and separating the recording head against and from the second recording medium in the serial recording mode; and a second driving power source for driving the second feeding means, the second driving power source being used for pressing and separating the recording head against and from the first recording medium in the line recording mode.

2. The recording apparatus according to claim 1, wherein the first direction is orthogonal to an arrangement direction of the recording elements and the second direction is orthogonal to the first direction.

3. The recording apparatus according to claim 2, wherein said recording head is a thermal head on which a plurality of heating elements are arranged in a row.

4. The recording apparatus according to claim 3, further comprising:

a first ink ribbon to be fed with the first recording medium by the first feeding means and to be melted by the heating elements of said thermal head in order to be used for recording in the line recording mode; and a second ink ribbon to be fed in a direction orthogonal to a feeding direction of the second recording medium and to be melted by the heating elements of said thermal head in the serial recording mode.

5. The recording apparatus according to claim 4, wherein said second ink ribbon is applied with inks having a plurality of colors, which are arranged in a predetermined order of color.

6. The recording apparatus according to claim 4, wherein said first recording medium and the first ink ribbon are accommodated in a first cassette and the second ink ribbon is accommodated in a second cassette.

7. The recording apparatus according to claim 1, wherein driving power of the first driving power source is used for pressing the recording head against the second recording medium when the carriage is moved forth in the first direction, and for separating the recording head from the second recording medium when the carriage is moved back in the first direction.

8. The recording apparatus according to claim 7, further comprising:

a first gear train for transmitting the driving power of the first driving power source when the recording head is in the second station;

a cam member which is rotated by the driving power transmitted from the first gear train;

a cam follower being in contact with the cam member; and an operational mechanism for pressing the recording head against the second recording medium and separating the recording head from the second recording medium according to movement of the cam follower by rotation of the cam member.

9. The recording apparatus according to claim 8, wherein said operational mechanism is constructed of:

a first swing lever on which the cam follower is disposed and supported rotatably on the carriage;

a press/release member connected to a side of the recording head opposite to a side where the recording elements are provided, and rotatably supported on the carriage;

a first spring one end of which being linked with one end of the swing lever and another with one end of the press/release member; and a second spring one end of which being linked with one end of the press/release member and another with the carriage.

10. The recording apparatus according to claim 9, wherein the cam member has a large diameter portion and a small diameter portion, and the first spring is extended due to spring power of the first and second springs when the cam follower is in contact with the large diameter portion to rotate the press/release member in one direction to press the recording head against the second recording medium, and the second spring is extended when the cam follower is in contact with the small diameter portion to rotate the press/release member in another direction to separate the recording head from the second recording medium.

11. The recording apparatus according to claim 9, further comprising:

a guide member disposed over the first and second stations;

a second swing lever, one end of which being rotatably supported on the carriage and supporting thereon a swing gear and another end being slidably supported on the guide member; and a gear follower disposed in the first gear train and selectively meshed with the swing gear according to rotation of the second swing lever.

12. The recording apparatus according to claim 11, wherein said gear follower is constructed of a pair of gears disposed separately from each other on both sides of the swing gear, and the swing gear is meshed with one of the gear followers according to rotation of the second swing lever when the carriage is in the second station and is not meshed with any of the gear followers according to rotation of the second swing lever when the carriage is in the first station.

13. The recording apparatus according to claim 12, further comprising a holding portion formed in the guide member, corresponding to the first station, another end of the second swing lever is held in the holding portion when the carriage is in the first station and the swing gear is not meshed with any of the gear followers.

14. The recording apparatus according to claim 1, further comprising a second gear train for transmitting driving power of the second driving power source;

a slidable gear disposed in the second gear train, which is slidable in correspondence with movement of the carriage;

a pressing/separating member rotatably supported in the first station, for pressing and separating the first recording medium against and from the recording head by means of the driving power of the second driving power source, the power being transmitted through the second gear train according to sliding movement of the slidable gear when the carriage is moved to the first station; and a roller member for feeding the second recording medium by the driving power of the second driving power source, transmitted through the second gear train according to sliding movement of the slidable gear when the carriage is moved to the second station.

15. The recording apparatus according to claim 14, further comprising a switching member for sliding the slidable gear to connect the second driving power source with the pressing/separating member through the second gear train when the carriage is moved to the first station and for sliding the slidable gear to connect the second driving power source with the roller member through the second gear train when the carriage is moved to the second station.

16. The recording apparatus according to claim 15, further comprising a contact member provided on the carriage, wherein the switching member changes a slide direction of the slidable gear when it is made to come into contact with the contact member during movement of the carriage.

17. The recording apparatus according to claim 1, further comprising:

a first platen for supporting the first recording medium so as to be opposite to the recording head in the line recording mode; and a second platen for supporting the second recording medium so as to be opposite to the recording head in the serial recording mode.

18. The recording apparatus according to claim 17, wherein the first platen is formed in the shape of a cylinder and the second platen is formed having a flat plane to support the second recording medium.

19. The recording apparatus according to claim 18, wherein said first platen is rotatably supported.

20. The recording apparatus according to claim 17, further comprising:

detection means for detecting which station the carriage is in, the first or the second station, the detection means being mounted on a route of moving the carriage by the carriage moving means; and control means for initializing the recording apparatus based on detection result of the detection means while separating the recording head and the second platen from each other in the serial recording mode at the second station, and while separating the recording head and the first platen from each other in the line recording mode at the first station.

21. The recording apparatus according to claim 20, wherein the detection means is disposed in an area of the first station in which recording is performed in the line recording mode.

22. The recording apparatus according to claim 21, wherein the detection means detects whether the carriage exists in the area of the first station and the control means initializes the recording apparatus based on detection result of the detection means.

23. The recording apparatus according to claim 20, further comprising a first cassette accommodating at least the first recording medium which is used in the line recording model; and a second cassette accommodating an ink ribbon used for performing recording on the second recording medium which is used in the serial recording mode.

24. The recording apparatus according to claim 23, wherein the first cassette accommodates an ink ribbon used for performing recording on the first recording medium.

25. The recording apparatus according to claim 23, further comprising:

cassette detecting means for distinguishing the first and second cassettes; and judging means for discriminating between the line recording mode and the serial recording mode based on detection result of the cassette detecting means.

26. A recording apparatus, comprising:

a recording head mounted on a carriage, on which a plurality of recording elements are arranged in a row;

first feeding means for feeding a first recording medium in a first direction with respect to the recording head;

line recording mode setting means for setting a line recording mode wherein the recording head in a fixed position performs recording on the first medium while said first feeding means feeds the first recording medium in the first direction;

carriage moving means for moving the carriage reciprocatingly in the first direction;

second feeding means for feeding a second recording medium in a second direction which is different from the first direction;

serial recording mode setting means for setting a serial recording mode wherein the recording head performs recording on the second recording medium which is in a stopped state while said carriage moving means moves the carriage mounting thereon the recording head in the first direction with respect to the second recording medium;

medium detecting means for detecting whether a recording medium on which recording is to be performed using the recording head is the first or the second recording medium;

input means for inputting a line recording mode command or a serial recording mode command; and judging means for discriminating whether detection result of the medium detecting means is in agreement with the recording mode command input by the input means.

27. The recording apparatus according to claim 26, wherein a first cassette accommodating at least the first recording medium is used in the line recording mode and a second cassette accommodating an ink ribbon used for performing recording on the second recording medium in the serial recording mode.

28. The recording apparatus according to claim 27, wherein said first cassette accommodates an ink ribbon used for performing recording on the first recording medium.

29. The recording apparatus according to claim 27, further comprising cassette detecting means for distinguishing the first and second cassettes, wherein the judging means detects whether detection result of the cassette detecting means is in agreement with the recording mode command input by the input means.

* * * * *